United States Patent [19]

Tsukata et al.

[11] 4,412,735

[45] Nov. 1, 1983

[54] IMAGE FORMATION APPARATUS

[75] Inventors: Masaharu Tsukata, Kawasaki; Koichi Murakami, Yokohama, both of Japan

[73] Assignee: Canon Kabushiki Kaisha, Tokyo, Japan

[21] Appl. No.: 257,359

[22] Filed: Apr. 24, 1981

[30] Foreign Application Priority Data

Apr. 26, 1980 [JP] Japan ..... 55-56081
Oct. 31, 1980 [JP] Japan ..... 55-154457

[51] Int. Cl.[3] ..... G03G 15/00

[52] U.S. Cl. ..... 355/14 R; 355/3 R; 355/14 C

[58] Field of Search ..... 355/3 R, 14 R, 14 C

[56] References Cited

FOREIGN PATENT DOCUMENTS 2948132 4/1980 Fed. Rep. of Germany .... 355/14 C

*Primary Examiner*—A. C. Prescott

*Attorney, Agent, or Firm*—Fitzpatrick, Cella, Harper & Scinto

[57] ABSTRACT

An image formation apparatus comprises copying process component for forming an image on a copy medium, component for presetting a number of times over which copying is repeated, wait component for inhibiting the starting of copying after closing of a main switch, component for instructing to start copying, sequence control component for starting the copying by the start component after the wait of the wait component has been released and for rendering the process component ready for the next cycle of copying after the repeated copying by the preset component has been terminated, component for warning of at least one of the trouble of the process component, the jam of the copy medium and the wait by the wait component in acoustic sound, and component for controlling the tone quality or sound volume of the warning component in accordance with the sequence of the sequence control component.

45 Claims, 36 Drawing Figures

START
a
INITIALIZE COPYING PROCESS LED OFF ?
NO
YES
COPY KEY ON ?
NO
YES
START COPYING PROCESS
I
ABNORMAL OPERATION DETECTED ?
YES
NO
SUSPEND COPYING PROCESS
CONTINUE COPYING PROCESS

IMAGE FORMATION APPARATUS

BACKGROUND OF THE INVENTION

1. Field of the Invention

This invention relates to an image formation apparatus such as a copying apparatus or the like, and more particularly to a device for detecting abnormalities such as sheet jam or the like in the image formation apparatus and for warning the user of such problems.

2. Description of the Prior Art

Heretofore, warning has been given to the user by detecting the presence of copy sheets in a copying machine, jam of a sheet or the like and turning on or turning on and off a light-emitting diode or the like. However, for example, where the user leaves the copying apparatus in the middle of multicopying, the user cannot be aware of any abnormality which may occur during the copying operation and this has led to a possibility that the user cannot judge and deal with the abnormality on the spot, thus allowing the accident to expand.

Therefore, to facilitate the discrimination between various types of abnormal conditions, it is possible to have the trouble indicated by an acoustic warning. However, an acoustic warning system has the merit of being capable of making the warning noticeable, although it may be a source of disturbing noise to a quiet office.

With copying apparatus, it has sometimes been the case that power is wasted due to the user forgetting to switch off the power source after completion of copying, or the photosensitive medium is deteriorated due to the apparatus being left unused for a long time after an accident such as copy sheet jam or the like has occurred, or that undesirable lapses occur with respect to maintenance, safety and the like of the copying apparatus.

If, as a counter-measure therefor, design is made such that the power source is cut off by a timer after a predetermined time, the power source will be cut off of its own accord in spite of it being required, and this has led to the cumbersomeness with which the power source is again switched on.

SUMMARY OF THE INVENTION

The present invention provides an acoustic sound indicator which overcomes the mutually contradictory points of trouble warning and noise.

More specifically, the present invention detects the condition of the machine, sheet jam or trouble of process means and acoustically warns of it and also controls the tone quality or sound volume of the warning device in accordance with the copying process sequence or non-sequence. Further, it controls said tone quality or sound quality in accordance with the image formation process cycle in the copying process sequence, the pre-process cycle such as the pre-cleaning of the photosensitive drum, or the post-process cycle such as the post-cleaning of the photosensitive drum.

Thus, during the time other than the image formation process cycle (during which noise is produced by a main drive motor for rotation the photosensitive drum or the like), warning can be given at a low sound volume and accordingly, the noisiness caused to others by an acoustic warning can be reduced. Moreover, during the process cycle, warning can be given at a high sound volume and the warning against a jam or the like may not be drowned by the main motor, sheet belt or the like.

The present invention detects the condition of the machine and abnormality such as sheet jam, process trouble or the like at a plurality of locations and acoustically warns of it, and also controls the copying sequence and acoustic device to effect different modes of copying suspending operations in accordance with the locations and effect different acoustic warnings in accordance with the different suspending modes. Further, it controls the different sequence suspending operations and the sound volume or tone quality of the acoustic warnings in accordance with the locations whereat sheet jam has occurred or the subjects of process trouble. Furthermore, in the event of a trouble which has occurred to a subject for which the sequence need not be suspended, or in accordance with the degree of the trouble, acoustic warning does not take place but indication is effected only by LED, liquid crystal or the like.

By this, the sound volume of the acoustic warning can be reduced for troubles other than jam trouble which needs an urgent measure, and thus noisiness can be prevented.

The present invention can detect the condition of the machine and sheet jam or process trouble and acoustically warn of it and can indicate it by LED, liquid crystal or the like, and has a manual key for selecting one or both of the acoustic warning and the indication warning. Further, it selectively controls those warning devices in accordance with the copying sequence or with the location or degree of the jam or trouble.

By this, the sound volume can be reduced in accordance with the atmosphere of the office or the degree of urgency and thus, noisiness can be prevented.

Also, the present invention detects the condition of the machine and sheet jam or process trouble and warns of it orally, repeats the oral sound warning and latches the repetition of the oral sound warning, releases the latch when the operator touches the machine housing or opens and closes the housing door to eliminate the jam or the trouble, and releases the latch of the oral sound warning by the use of a release (reset) button adapted to be manually operated to render the re-starting of copying possible after elimination of usual jam sheet. Usually, the present invention releases the latch of the oral sound warning by the use of a clear key for cancelling the number of repeat copies set in a memory by ten-key. The present invention also usually releases the latch of the oral sound warning by the use of a suspending key or a stop key for suspending the repeat copy sequence and holding the then number of remaining copies.

By this, the warning can be made noticeable and the oral sound can be simply released without the necessity of providing any special device.

Also, the present invention detects the condition of the machine and sheet jam or trouble and warns of it orally, causes the statement in that oral sound to be repetitively made, and automatically stops the oral sound warning when the repetition number of that statement is counted a predetermined number of times. Or it stops the oral sound warning when that statement is repeated for a predetermined time. Further, after the stoppage, the present invention automatically changes over to the indication by LED, liquid crystal or the like. When the aforementioned clear key or the like is depressed during the repetition of the statement, the oral sound is stopped immediately without waiting for the termination of the predetermined repetition number or the lapse of the predetermined time.

The present invention detects the condition of the machine and sheet jam or trouble and warns of it orally and can arbitrarily or automatically select the repetition interval, the repetition number or the repetition time of the statement in that oral sound. That is, it controls the repetition interval, the repetition number and the repetition time of the statement in accordance with the aforementioned copying sequence or non-sequence or with the location and subject of jam or trouble. In the present invention, an input key is provided which is capable of selecting the repetition interval, number and time, which is made possible by a ten-key for setting the number of repeat copies.

Also, the present invention can teach the treatment procedure during a jam and the copying operation procedure by oral statements, thereby facilitating the operation. Particularly, a feature of the present invention exists in the provision of a guide key and a check key.

The present invention eliminates the disadvantage in forgetting to switch off the power source, and is characterized by a device for detecting ambient brightness or sound, a power switch, a warning device, and a control device for comparing the detection signal with the input condition by said power switch to thereby operate said warning device.

The present invention effects the warning by detecting the condition of a housing switch, a door switch or the like for making the warning possible.

Also, the present invention puts out warnings in the form an acoustical sound statement and repetitively puts out the same statement, and stops the output or forcibly cuts off the power after a predetermined time or a predetermined number of times of output, and the stoppage of the output takes place only in a predetermined condition after the state of the machine such as opening-closing of the door switch has been determined.

In the case of a copying apparatus, when it has been detected that the intensity of the ambient brightness or sound around the apparatus is below a certain reference value and is the copying apparatus is not in copying operation, a sound aurally perceptible to the operator or neighboring persons is generated. Such sound is generated with a predetermined time delay after completion of copying, completion of exposure or stoppage of rotation of the image transfer drum.

The invention will become more fully apparent from the following detailed description thereof taken in conjunction with the accompanying drawings.

DESCRIPTION OF THE PREFERRED EMBODIMENT

Figure 1:
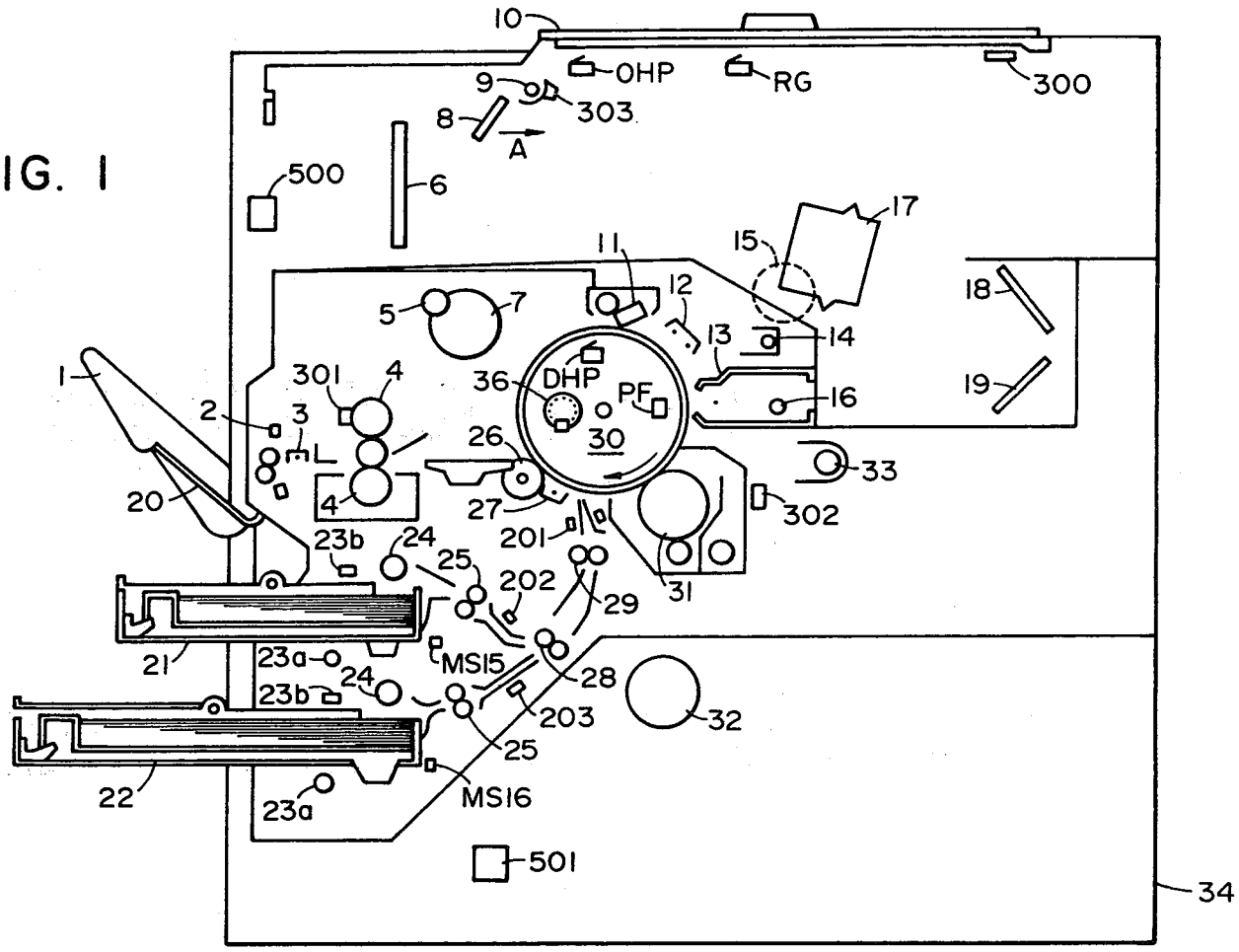
FIG. 1 is a cross-sectional view of a copying apparatus of which the present invention is applicable.

FIG. 1 is a cross-sectional view of a copying apparatus to which the present invention is applicable. An original is placed on an original carriage forming an original supporting surface, and is held down by an original keep plate 10. An optical system comprises an illuminating lamp 9, movable mirrors 8 and 6, a lens 17 and fixed mirrors 18 and 19. The light image passed through the optical system is projected upon a photosensitive drum 30.

First, there is a copy preparation delay or wait time such as a drum rotation time from after the unshown main switch of the copying apparatus is closed until the cleaning of the photosensitive drum is completed, or a wait time until a heat-fixing roller 4 rises to a certain standard temperature. When it is read into a microcomputer that said wait time has terminated and that a copy key for instructing the copy start which will later be described has been depressed, the following process sequence is started.

The operation of the FIG. 1 apparatus will be described by reference to the time chart of FIG. 3 after the closing of the main switch SW.

When the copy key is depressed, a main motor M1 is energized and the potential of the drum is made uniform for a predetermined time (one full revolution of the drum 30) and the cleaning of the drum is executed, whereafter the latent image formation sequence is entered. That is, the original is scanned by the movable mirror 8 moved with the illuminating lamp 9 in the direction of arrow A and the movable mirror 6 moved in the same direction at $\frac{1}{2}$ of the movement velocity of the movable mirror 8 with the length of the light path maintained constant by these movable mirrors and is further slit-exposed via the lens 17 and fixed mirrors 18, 19 and imaged on the drum 30 having a photosensitive medium on the surface thereof. That is, the original is slit-exposed while being scanned by the optical system (illuminating portion). The surface of the drum 30 has a photosensitive medium comprising a photoconductive layer covered with a transparent insulating layer. The photosensitive medium is first charged to the positive polarity by a plus charger 12 supplied with a positive high-tension current from a high voltage source (not shown). Subsequently, when the photosensitive medium arrives at an exposure station 16, the original on the original carriage glass is illuminated by the illuminating lamp 9 and imaged on the drum 30 by the movable mirrors, the lens and the fixed mirrors and thus, the photosensitive medium is exposed to the image of the original while, at the same time, it is subjected to AC discharge by an AC discharger 13 which is supplied with an AC high-tension current from a high voltage source.

Subsequently, the photosensitive medium is subjected to the whole surface exposure by an all surface exposure lamp 33, whereby an electrostatic latent image is formed on the drum surface (photosensitive medium), whereafter the drum enters a developing device 31.

The electrostatic latent image is developed into a visible image by the developing device 31 which adopts the sleeve type powder development system.

A sheet of transfer medium is then fed from a cassette 21 or 22 by a paper feed roller 24 and conveyed by first rollers 25 and second rollers 28 and temporally stopped by timing rollers 29, which are thereafter rotated by a registration signal RG to convey the paper again and thus, the leading end of the paper comes into registry with the leading end of the developed image. The registration signal may be provided by a switch RG which detects a particular passage position of the optical system. A switch OHP produces a signal indicative of the optical system home position (stop position). Both of these switches are actuated by a cam provided on the optical system (mirror 8).

The transfer medium so conveyed is brought into intimate contact with the drum, so that the image on the drum is transferred to the transfer medium by a transfer charger 27 with the aid of the positive high-tension current from a high voltage source.

After the image transfer has been terminated, the transfer medium is separated from the drum by a separating roller 26 and directed to a heat-fixing roller 4 for fixation of the transferred image, whereafter any excess charge on the transfer medium is removed by a discharger 3 and the transfer medium is discharged into a tray 20 by discharge rollers. This completes a cycle of copying. On the other hand, the drum surface (photosensitive medium) is cleaned by a blade 11 urged thereagainst to remove any toner remaining on the drum, thus becoming ready for another cycle of copying. The above-described cycle may be repeated by entering and presetting a desired number of such copy process operations as described above with the aid of a numeric key (ten-key) on a keyboard which will hereinafter be described.

Switch PF is actuated to produce a paper feed signal by a cam provided on the drum. Switch DHP is actuated to produce a drum home position (stop position) signal by the drum cam and stop the drum at a position whereat the seam of the photosensitive medium bears against the cleaner 11. Reference characters 23*a* and 23*b* designate a lamp for detecting the presence of paper in the cassette and a light-receiving element for receiving the light from the lamp, and reference numeral 2 denotes a paper detecting lamp and associated light-receiving element for detecting the delay of paper and the stagnation of paper thereat. Designated by 16 is a blank exposure lamp which exposes the photosensitive medium when image exposure is not occurring, thereby eliminating irregularity of the surface potential of the photosensitive medium. Reference numeral 7 designates a motor for rotating the fixing roller, reference numeral 15 donotes a motor for moving the optical system backwardly, and reference numeral 14 designates a pre-exposure lamp for prefatiguing and making uniform the photosensitive medium before the process. Designated by 36 is a pulse generator comprising a plate rotatable in response to the drum and an optical detector for detecting the aperture in the plate.

There are arranged three microswitches MS15 and three microswitches MS16 for detecting the presence and size of the cassettes. When none of these switches is in the ON position, there is no cassette and, when all of them are in ON position, size discrimination is effected by CPU, to be described depending on the combination of the ON positions of the switches. The discriminated size of a selected upper or lower cassette is indicated by LED and the statement of that size is uttered only once by a speaker. The absence of the cassette is also indicated in a like manner and is also indicated orally. Such utterance takes place when the upper/lower select key 29 of FIG. 2 has been depressed or when an oral key 231 or 233 has been depressed. If it is before the copy sequence is started, "prepare a cassette" is uttered only once to hamper the copy start. However, when the cassette being used has been drawn out during the copy sequence, "the cassette has come off" is uttered several times and the process cycle for the already fed paper is brought to an end and the repeat operation is interrupted with the number of remaining copies memorized.

Likewise, when the absence of paper has been detected by a sensor 23*b*, "prepare paper" and "paper has become exhausted" are uttered once and several times, respectively, in accordance with the time zone when such absence has been detected.

In the event there is no cassette or no paper, utterance may be effected only once, when the copying has been interrupted by the detection thereof and the machine stopped.

Designated by 302 is a search coil for detecting the amount of developing toner by detection of the $\mu$ variation resulting from any level change and for putting out a signal indicative of no toner. This also orally indicates "no toner".

Denoted by 301 is a thermistor for detecting the temperature of the fixing roller 4. When it detects an over-temperature, it reduces the power supply to the heater within the roller 4 to one half. Designated by 300 is a thermistor for detecting the temperature of the platen glass on which the original is supported. It detects an over-temperature and interrupts the sequence in the same manner as when the absence of paper is detected. Reference numeral 303 designates a temperature fuse for detecting the over-temperature of the lamp 9 and cutting off the power supply to the lamp. A waiting time is also indicated by this thermistor.

Denoted by 201, 202 and 203 are microswitches for detecting a sheet. When they detect no sheet at their respective points within a predetermined time after paper feed, it is judged as a jam by CPU to be described and in the case of the microswitch 201, simultaneously with the detection of the jam, the power supply to the fixing heater H and the primary and secondary transfer DC chargers is stopped and the power supply to a drum motor $M_1$ and AC charger is stopped with a delay corresponding to one revolution. Thereby, the normal sheet after the image transfer station can be discharged. In the case of a jam detection by the microswitch 202 or 203, it is judged as erroneous feeding from the cassette and the sequence is interrupted in the same manner as in the case of no paper. In the event of jam at the discharge station 2, all the power supplies are quickly stopped to prevent the accident from being increased. The statement is changed and uttered in accordance with the place at which the jam occurs.

Figure 2:
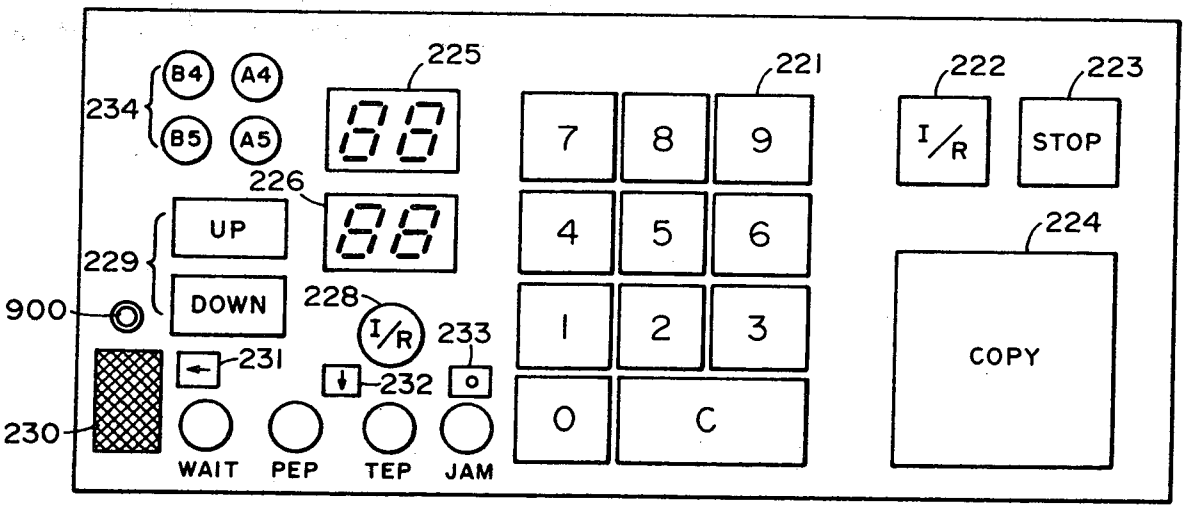
FIG. 2 is a plan view of the operating portion of the FIG. 1 apparatus.

FIG. 2 shows the operating portion of this copying apparatus. The operator can set a desired number of copies up to a maximum 99 on an indicator 225 by depressing any one of numeric keys 221 from 0 to 9. When the main switch is closed, "1" is indicated on the indicator 225 and if a sheet of copy is desired, the operator need not depress any numeric key.

The "CLEAR" key may be used when the set content of the indicator 225 is to be rendered to 1. "COPY" key 224 is for effecting the copying by the desired value indicated on the indicator 225 and, once this key is depressed, the machine enters a copying operation. When the optical system has arrived at its reverting position, the value on an indicator 226 is incremented from 0. At the point of time whereat the set value on the indicator 225 agrees with the value on the indicator 226 which indicates the number of copied sheets, the copying operation mode becomes a post rotation end mode (post) and, at the point of time whereat the copying operation terminates with the photosensitive drum stopped, the indicator 226 is reset to "0". Accordingly, the value initially set by a key still remains on the indicator 225 and therefore, when it is desired to produce the same number of copies of another original, the "COPY" key may be depressed again. During copying operation, when the "STOP" key 223 is depressed at a point of time whereat the counted number has not yet reached the set value, or when one of indicators (PEP, 228) and LED (FIG. 12) is turned on, the copying operation for one sheet at that point of time is terminated to terminate the process cycle. Accordingly, for example, if said condition is brought about in the case of a counted value "3" for a set value "6", the indicator 225 will be stationary at "6" and the indicator 226 at "3". When all the stop conditions are released, operation can be started directly from that condition by the "COPY" key. Such interruption copying can be effected by the use of "I/R" key 222. If, when the copying by a first operator is at a set value "6" and a counted value "3", a second operator wants to produce two interruption copies, the second operator may depress the "I/R" key 222, retract the set value "6" and the counted value "3" of the indicators 225 and 226 into another memory, cause the indicators 225 and 226 to indicate "1" and "0", respectively, and turn on an I/R lamp 228. When one interruption copy is desired, if the "COPY" key is depressed, there will be obtained a sheet of copy. When two interruption copies are desired, "2" may be entered as the set number by a numeric key, whereafter the "COPY" key may be depressed, whereby two copies may be completed. After termination of this copying, the values "6" and "3" for the first operator are automatically called back to the indicators 225 and 226, respectively, so that the first operator may again depress the "COPY" key to obtain the remaining three copies.

Indication lamp 228 "I/R" is turned on upon depression of the "I/R" key and is turned off when interruption copying is terminated or interrupted.

The "STOP" key, when depressed after the interruption copying instruction, can release the interruption with the number of sheets.

Designated by 230 is a speaker which may utter oral statements. It may effect warnings of a sheet jam, process trouble, confirmation of the preparation for copying, how to handle the copying machine, how to deal with a jam, life of members, etc.

Reference numeral 231 designates a key for selecting only the speaker 230 for the purpose of indication, and reference numeral 232 denotes a key for selecting and operating only LED indicators JAM, TEP and WAIT. Warning indication may be effected by both of these keys if no other key is depressed.

Designated by 233 is a key which may be depressed in the event of a jam to cause the speaker 230 to orally teach how to deal with the jam. If this key is depressed before copying is started, it will orally teach the procedures of copying.

Indicator JAM may be turned on upon detection of the jam and cause the copying to shift to a termination mode in accordance with the place whereat the jam has been detected, as previously described.

In this case, this indicator is turned on and off to cause the speaker 230 to repeat a statement that "jam has occurred at the exit" until the sound is released. In the event of jam at switch 201, it repeats "intermediate jam has occurred" several times, whereafter it stops the utterance.

The indication of "TEP" is turned on by a sensor 302 when the toner in the developing device has become exhausted, and it does not affect the starting or continuation of copying. In such case, the speaker 230 repeats "supply toner" a few times, whereafter it stops the utterance.

"PEP" is turned on when paper has become exhausted in a selected cassette, thereby inhibiting the starting of copying or terminating the continuation of copying and operating the speaker 230 as previously described. In the event a jam at switch 202 or 203 has been detected, "paper feed has failed" is repeated a few times, whereafter copying is stopped. "WAIT" is turned on for a time until the temperature of the fixing device reaches a predetermined value, thereby inhibiting the starting of copying, but once that temperature is reached, "WAIT" renders the starting of copying (exposure) possible and holds that possible condition. When "WAIT" has been released, the speaker 230 repeats "copying is OK" a few times, whereafter it stops the utterance. This waiting time is detected and effected by a temperature sensor 301.

Reference numeral 229 designates a switch for selecting the upper cassette or the lower cassette, and reference numeral 234 denotes an indicator for indicating the size of the selected cassette.

When a trouble has been detected before the copy sequence, the warning of no cassette, no paper or no toner is given in the form of the aforementioned statement by the speaker 230 during the closing of the main switch and during the depression of the copy key. When a trouble has been detected during the copy sequence, warning is immediately given in the form of the aforementioned statement and moreover at a greater sound volume (3 dB) than that before the starting of the sequence. During the pre-process stage which takes place in the copy sequence but at which the process cycle has not yet been entered after the starting of copying, the operator is still close to the machine and therefore, warning is emitted at the same low sound volume as during the non-sequence.

When key 233 is depressed upon detection of jam, the warning sound so far given is stopped and the speaker is operated to utter once "open the left door" in this case, "open the front door" in the event of a jam at switch 201, or "draw out the cassette" in the event of a jam at switch 202 or 203. These statements are made at a low sound volume of the order of 3 dB (equal to or less than the warning sound volume before the starting of the sequence).

When the temperature rise of a process load such as a lamp or the like is detected by 300, 301 or 303, the set number indicator 225 is changed over from the so far indicated value to an error indication E1, E2 or E3 in response to the detecting sensor. At the same time, the speaker 230 is operated to repeat ". . . is overheated" n times, whereafter it stops the utterance. Further, during the copy sequence, warning is given at a sound volume higher by 3 dB than that during the non-sequence so that the warning is not drowned out by the motor noise during copying operation. Also, in the event of lamp overheating, the speaker is operated to give a warning at a sound volume higher by 3 dB than that during the other case. It should be noted that when a trouble occurs to the clutch for reciprocally moving the mirrors 6, 8 and these mirrors fail to return to their home positions, it is detected and a similar error indication and oral warning are effected.

Instead of increasing the sound volume, the interval at which a statement is repeated may be shortened. Design may also be made such that the sound volume, the frequency of statement and the repetition interval are selected as desired.

Figure 3:
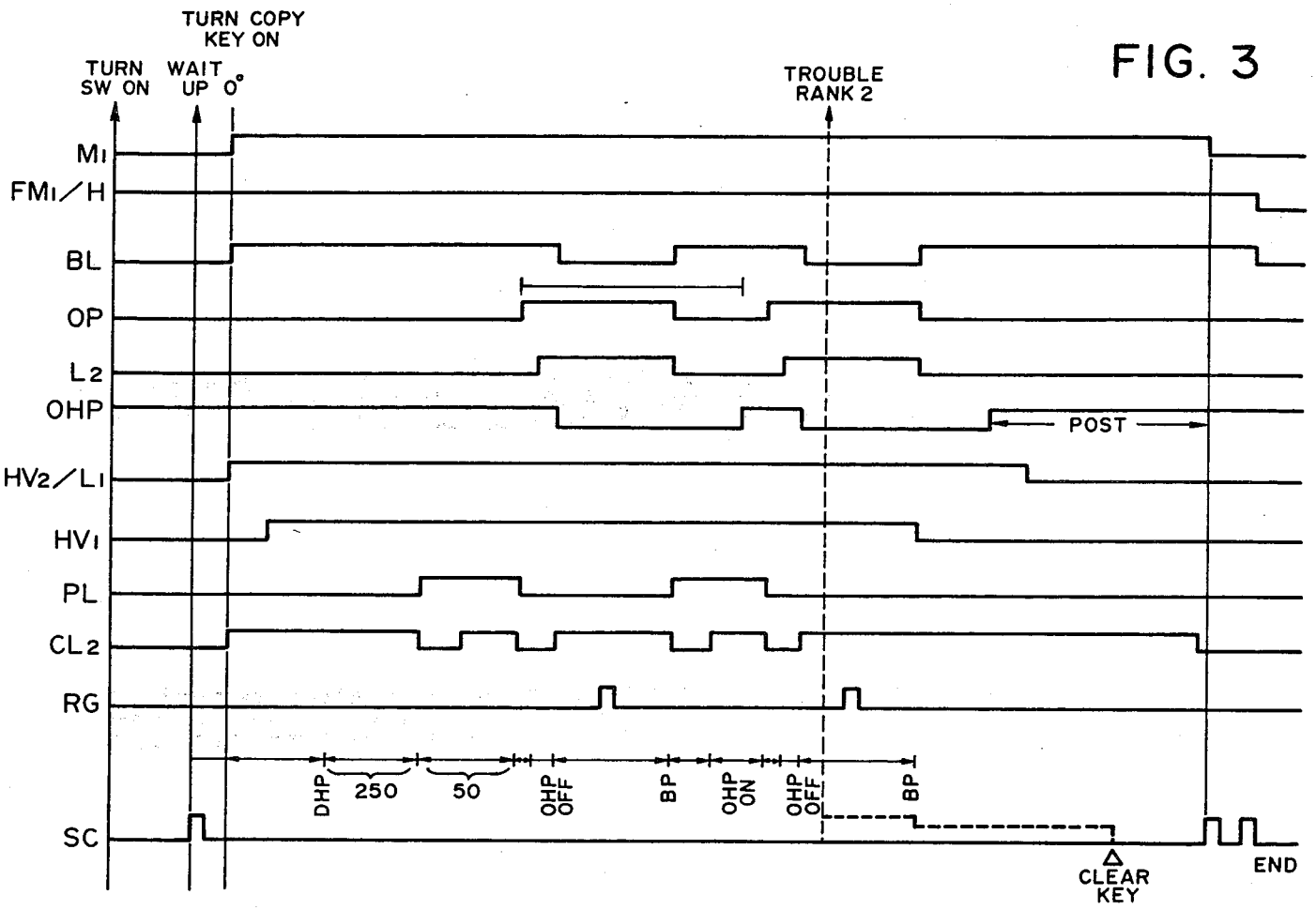
FIG. 3 is an operation time chart of the FIG. 1 apparatus.

FIG. 4 shows a control circuit for executing the above-described operation, and FIG. 3 is the output time chart thereof. In FIG. 3, $M_1$ is a motor drive signal for rotating the photosensitive drum 30, $FM_1$ designates a fan motor for cooling the interior of the machine, PL is a solenoid ON signal for lowering the paper feed roller 24, $CL_2$ is a clutch signal for rotating the first register rollers 25, OP designates a clutch for forwardly moving the optical system 6, 8, 9, $HV_1$ is a power source ON signal for imparting a high voltage to the primary charger 12, $L_1$ is a signal for turning on the whole surface exposure lamp 33, $L_2$ is a signal for turning on the exposure lamp, BL is a signal for turning on the blank lamp, $HV_2$ is a power source ON signal for imparting a high voltage to the secondary charger 13, $CL_3$ is a clutch signal for rotating the second register rollers 29, RG is a signal for taking the second register rollers ON timing which is provided by a switch actuated by a cam provided on the optical system, and OHP is an optical system stop signal provided by a similar optical system cam switch.

In FIG. 4, a well-known microcomputer is employed as a central processing unit 800. ROM is a memory containing therein a program for executing the process sequence as shown in the time chart of FIG. 3 and indication and utterance control. The program is stored in the ROM in the microprogram fashion using binary-coded instruction words.

RAM designates a data memory containing therein necessary data for the execution of said program and data including key input signals such as the set number of copies and detection input signals such as the number of copies produced; $I_1$ and $I_2$ denote input ports for inputting key signals and detection signals to the CPU; $D_1$ and $R_1$ designate output ports for latching the output signal from the CPU; IA denotes a high priority interruption input port; and IB designates a low priority interruption input port. An abnormality detection signal is input to IA, and a clock pulse for sequence timing is input to IB.

The CPU is a processing unit having the function of an accumulator ACC which temporally contains therein the data from each input port and the data to each output port, the function of a decoder which decodes the codes of the ROM, and the function of ALU which operates and logically judges the data from the ROM, RAM, input and output ports. MCOM 44, 45, etc. produced by Nichidensha Co., Ltd. are available as the microcomputer 800.

Input data are entered and processed in accordance with the execution of the program of the ROM, and introduced into ACC by a particular step and logically judged. The processing of the CPU proceeds to the next step, where it effects the control of copying operation load, the indication of warnings and the indication of numerical values.

IB is connected to $C_1$ and inverter i which waveform-shape the pulse output of a clock signal generating light-receiving element $D_3$, and IA is connected to $C_1$ and i which waveform-shape the output of a trouble detecting circuit constituted by the aforementioned sensors 300, 301, 303, 23*b*, etc. or an operational amplifier OA provided by these sensors. All key input means such as copy key 224, LED, sound selecting keys 231, 232, etc. are connected as switches at the matrix intersections between a strobe signal line and the input port lines of entered port $I_1$ so as to be input in the dynamic scan fashion. Microswitches for generating copy sequence timing signals such as DHP, PF, OHP, RG, etc. and switches 2, 201–203, MS15 and MS16 for detecting jam are connected to the port lines of input port $I_2$. Stop position signals DHP and OHP are not connected to interruption ports IA and IB and therefore, a condition in which interruption is applied to the machine to render it inoperative can always be prevented simply.

The port lines of output port $\theta_1$ are connected through a drive amplifier a to the drum motor $M_1$, and paper feed plunger PL, etc. which are process sequence loads.

LED is connected to each line of $\theta_2$ to turn on and off the alarm indication LED (JAM, etc.), and 7-segment indicators 225 and 226 are connected to 74 $_3$ so that column selection pulse and segment pulse are put out.

SC designates a sound composite unit for forming the aforementioned statements, and D/A denotes a D/A converter for operating the speaker 230. ROM' stores therein the sound data of various statements. These various statements can be appropriately prepared by the designer so that they are easily comprehensible to the user for respective alarms of abnormality. Said data comprises band-compressed information of statement sounds and is a characteristic parameter of the statement sounds. SC effects two operations. First, it accesses, from ROM', a characteristic parameter indicative of a statement corresponding to an abnormal portion from among the signals received from the CPU. This is effected so that the ROM' is addressed by the CPU for each word. That is, the CPU selects the words in the ROM' and combines them to prepare a statement. Accordingly, SC sends a signal to the CPU each time a word is output, thereby assisting in access control. Also, the sound composite unit SC has a digital filter, and the characteristic parameter accessed from the ROM' is input to said digital filter, whereby it is put out as the digital information of the statement. This is passed through the D/A converter and thereby made into a sound. The parameter signal put out from the CPU includes information indicative of a sound volume and this information controls the amplitude of the voltage input to the speaker 230. The second volume can be varied by gain-adjusting the amplifier a itself by the signal from the CPU 800 without the intermediary of the SC circuit.

Figure 4A:
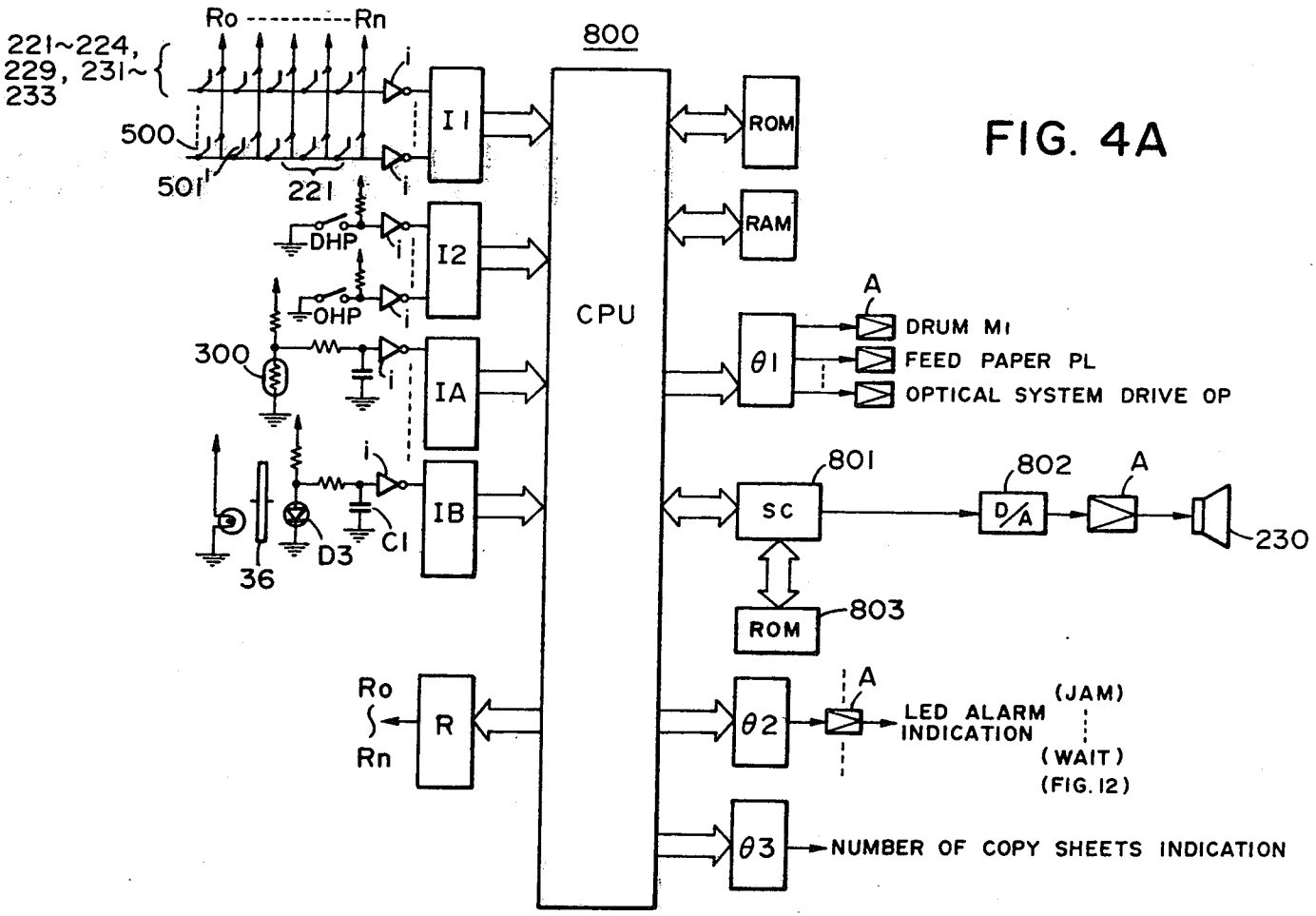
FIGS. 4A and 4B are diagrams of the control circuit in the present invention.
Figure 4B:
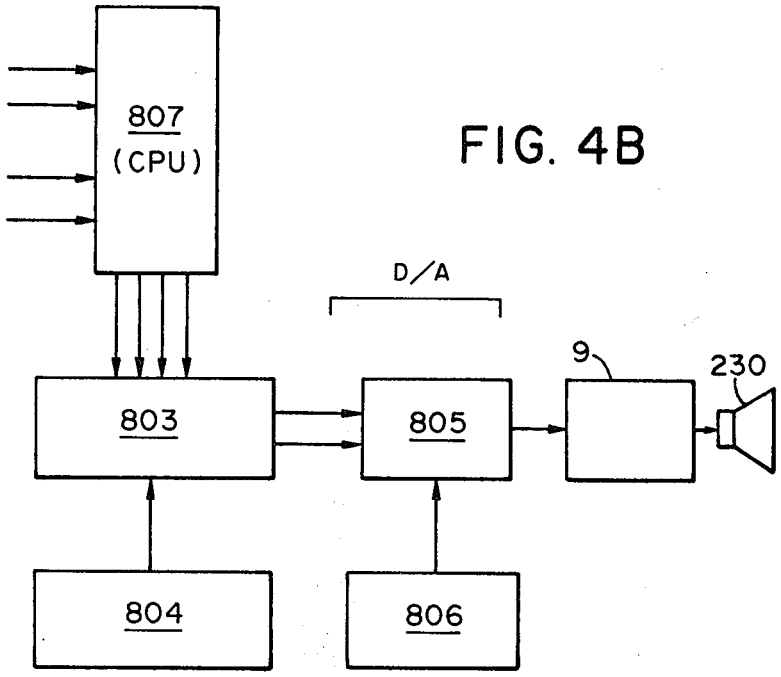
Figure 4C:
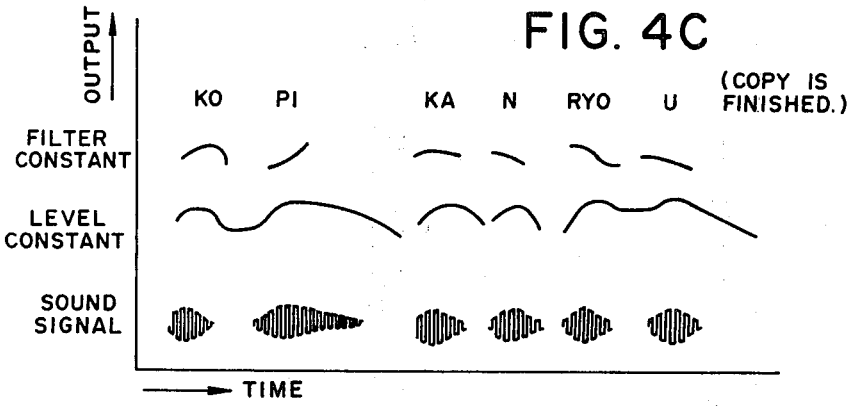
FIGS. 4C and 4D show waveforms.
Figure 4D:
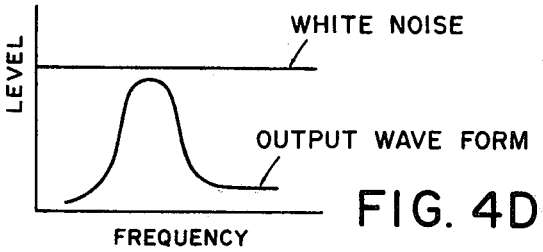

FIG. 4B shows another example of the sound composite system in which elements 801–803 are replaced by elements 804–806. The generation timing circuit 804 scans the read only memory 803 in a time-division fashion. The sound signal generating filter 805 controls the signal from the white noise generator 806 by the level constant and filter constant from the read only memory 803 and puts outs a sound signal. Voiced/voiceless information, power level and pitch frequency may be mentioned as the sound source information in a sound. The above-mentioned level constant is a constant for varying the power level, and the filter constant is a constant for selecting the pitch frequency. Accordingly, a waveform as shown in FIG. 4D which is determined by both the level constant and the filter constant is obtained from the filter 805. Therefore, the read only memory 803 is controlled in a time-division fashion by the outputs of the CPU and the generating timing circuit to vary the level constant and the filter constant, whereby the output waveform of the filter is varied and audible as a sound. That is, it becomes the sound signal as shown in FIG. 4C.

Assuming, for example, that a copy end signal has been put out from the detector, the read only memory 803 is accessed on the basis of the signal from the CPU 800 or encoder 807 to select a language row that "copy is finished". The read only memory 803 is controlled in a time-division fashion by the generating timing circuit 804 and supplies the level constant A and the filter constant B of the selected language row to the sound signal generating filter 805. The sound signal generating filter 805 controls the signal from the white noise generator 806 by the level constant A and the filter constant B and generates a sound signal, which is supplied through the output amplifier 9 to the speaker 30, which orally indicates "copy is finished".

Operation will now be described.

When the main switch SW is closed, whether or not the optical system is in its stop position OHP is discriminated and if it is not in such position, OP is turned on to return the optical system to said position. If the optical system fails to return within a predetermined time, OP is turned off and an error indication is effected to given an oral warning. Subsequently, indicators 25 and 26 are caused to indicate 01 and 00, which are stored by the RAM.

The ON condition of the COPY key and numeric keys is scanned by the time-division signal from output ports $R_o$-$R_n$ and dynamically input to the input port $I_1$. The computer reads that input signal and drives the drum motor $M_1$. As the drum is rotated, an intermittent light signal is generated by a disc 36 rotated in response to the drum motor and such signal is detected by a light-receiving element $D_3$, which thus generates drum clock pulses. When DHP signal is generated by an optical detecting switch at the drum home position, 250 drum clock pulses CP, for which paper feed plunger PL is energized, start to be counted. That is, by the inputting of the DHP ON signal to input port I2, the reception of the drum clock pulses to the interruption port IB is started. When a predetermined number of drum clock pulses is counted, a drive signal is put out from the output port $\theta_1$ to energize the paper feed plunger PL, which thus lowers the normally rotating paper feed roller to start paper feeding. After 50 clock pulses, the plunger PL is deenergized and from the next DHP signal, 100 clock pulses are counted and, in the same manner as described above, the optical system driving plunger OP is energized to move the optical system and at the same time, exposure is started. The deenergization of those instruments and the operation of other instruments which require timing are controlled in a similar manner. If the optical system fails to return to DHP within a predetermined time after the start thereof, optical system error indication and a sound alarm similar to those before the start of copying are effected.

Figure 5A:
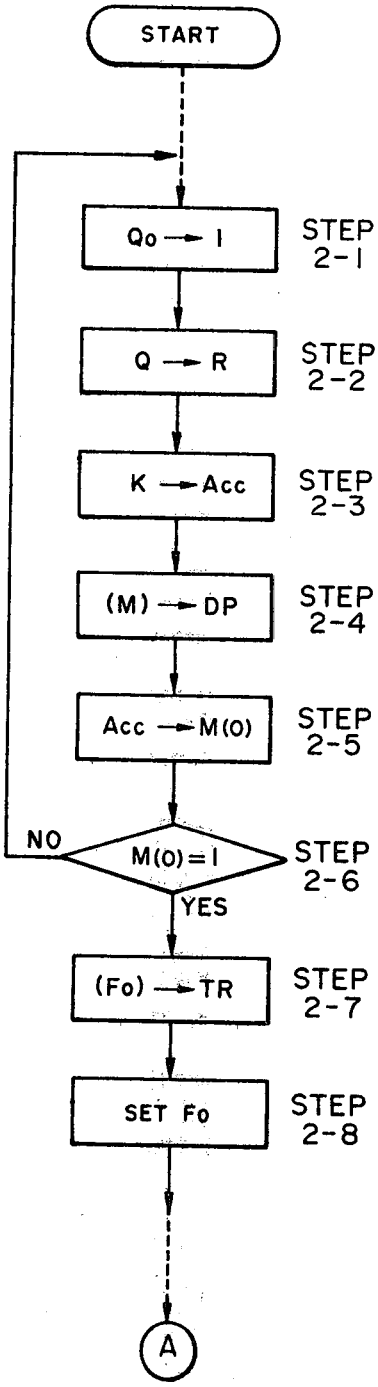
FIGS. 5A, 5B and 6A are sequence control flow charts of the FIG. 4A circuit.
Figure 5B:
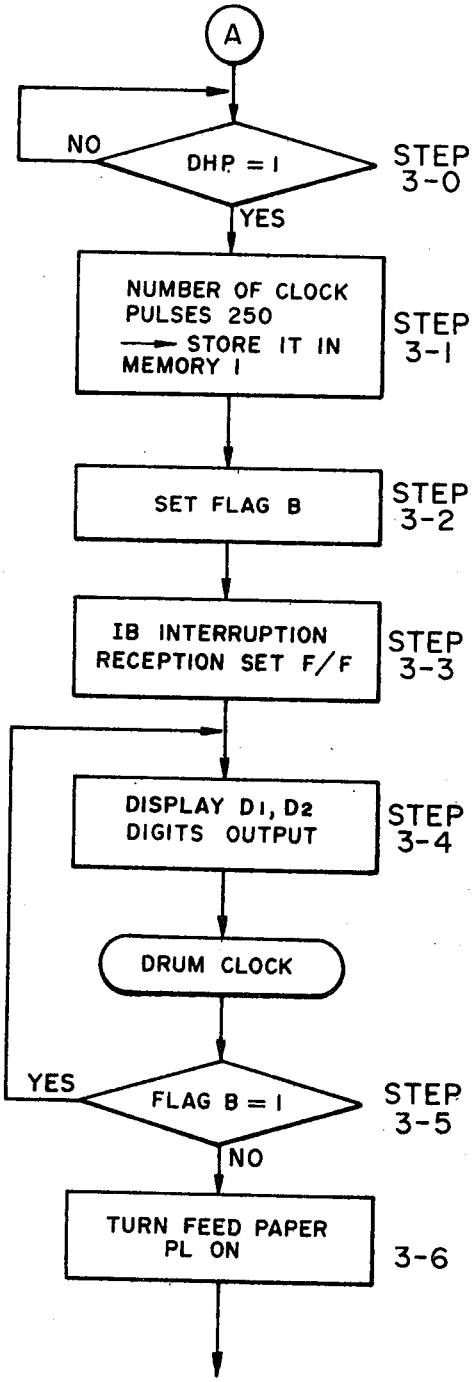

Operation wil be described more specifically with reference to FIGS. 5A and 5B.

When the computer starts operating upon closing of the main switch, ROM address is designated in accordance with the computer clock, an instruction code is put out and the program of the ROM is executed. At step 2-1, the 1 bit, i.e., $Q_0$, of register Q is set. At step 2-2, 8 bits of registers $Q_0$-$Q_7$ are put out to $R_0$-7. At step 2-3, the input data to input port K is contained in accumulator ACC and at this time, $R_0$ is being put out and therefore, whether or not COPY button is ON is discriminated by the input ON level to $K_0$. When data corresponding to $K_0$-3 are contained in ACC, 1 is given to the bit corresponding to $K_0$. At the next step 2-4, data for designating the memory RAM address is set in register DP, at step 2-5, the data contained in ACC at step 2-3 is transferred to the (00) address of RAM (FIG. 13) designated by that register, and at step 2-6, whether or not the 0 bit of this data is 1 is discriminated. If it is 1 (yes), the next step 2-7 is executed and a data for designating the output port $\theta_1$ is put out from the ROM and contained in register TR. At step 2-8, the output port $\theta_1$ is set and the drum driving motor is energized by the out of this output port $\theta_1$ through a driver. If 0 bit is 0 at step 2-6, the flow from step 2-1 is again repeated.

Figure 6A:
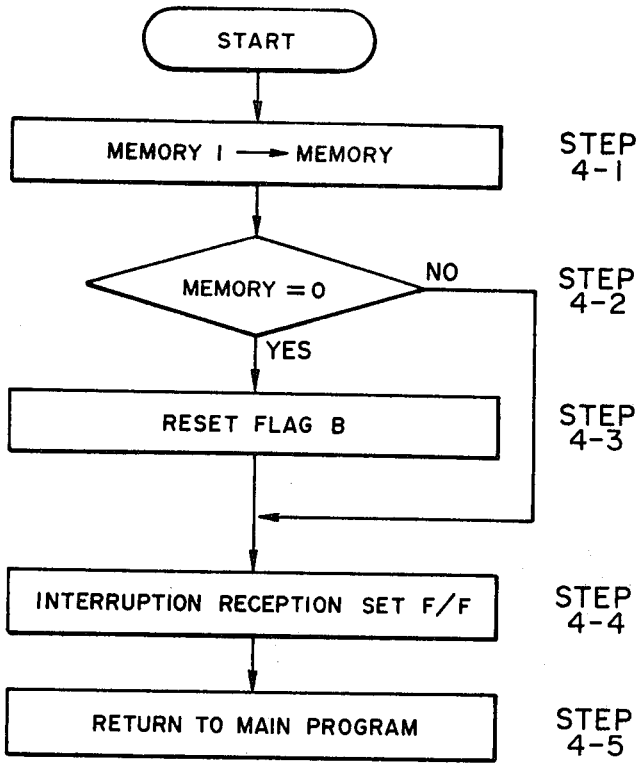
Figure 6B:
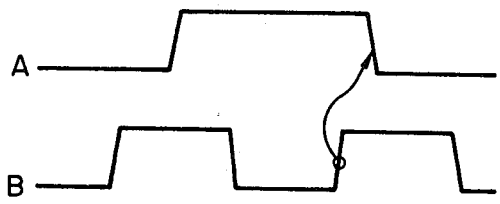
FIG. 6B shows the waveforms in FIG. 6A.

Reference is now made to FIGS. 6A and 6B to describe the drum clock count by the interruption system in an example wherein 250 drum clock pulses are counted to turn on signal PL for driving the paper feed plunger.

At step 3-0, whether the drum home signal has been input to the input port I2 is discriminated. At step 3-1, 250 codes are put out from the ROM and contained in the RAM and at step 3-2, flag B in the flag register of the RAM is set (to 1). At step 3-3, the interruption receiving flip-flop of the interruption port IB is set to enable the interruption of drum clock pulses. At the next step 3-4, the time-division signals by set and reset are put out from $R_6$ and $R_7$ to change over the place of the indicator, and a signal for segment is put out from $D_3$ to dynamically turn on the indicators 225 and 226. This step includes multiple instruction codes from the ROM code read-out to the output from the output port. The seven light-emitting segments of the indicator 225, 226 indicate a set number when a key input has been effected, and each time a copy is finished, they indicate a number equal to that number minus 1. The indication is intermittently effected at this step. At step 3-4, the condition thereafter of the flag set at step 3-2 is discriminated and if the condition is unchanged, the program waits until the flag is reset. However, if drum clock pulse is generated in the meantime, the interruption receiving flip-flop F/F is reset by the rising of that pulse with respect to IB and an interruption input is effected.

Thereby, the then designated address of the ROM by a program counter is retracted into a register STACK and other particular address (for example, 100) of the ROM is newly set in the counter. From the address 100 of the ROM, the interruption routine program as shown in FIG. 6A is stored which is executed by the rising of the drum clock pulse. Accordingly, the program so far executed is interrupted and the program of drum clock pulse count is executed. When the execution of this program is terminated, the address retracted into the register STACK is again set in the counter and the main program from the next address is executed.

FIG. 6A shows the program of that interruption routine. At step 4-1, the value 250 contained in the memory at step 3-1 is decremented and at step 4-2, whether or not the value has reached 0 is discriminated. Since it is the first drum clock pulse after the drum home signal DHP has been detected, it is not 0 and accordingly, the program skips over step 4-3 and proceeds to the next step. At step 4-4, the interruption receiving flip-flop F/F is set so that interruption is again applied when the program has returned to the main program. If the rising of the drum clock pulse occurred immediately before step 3-4, the program returns to step 3-4 of the main program in accordance with the instruction of step 4-5.

The indicator is again operated. When the next clock pulses CP is input to the port IB, F/F which has so far been set is reset by the rising of the pulse CP and the interruption count routine is again carried out.

In the meantime, 250 clock pulses are counted and when the result of subtraction becomes 0, flag B is reset by step 4-3. Therefore, when the program has returned to the main routine, step 3-4 is gone through and step 3-5 is executed to set the output port $\theta_1$ and thus, paper feed signal PL is turned on.

In this manner, lamp $L_1$ for other operating instruments, motor $M_2$ for driving the drum, clutch OP for forwardly moving the optical system, primary charger $V_1$, secondary charger $HV_2$ and clutch CL for driving the timing rollers are also timing-controlled.

The signal A in FIG. 6B is the output signal of the F/F connected to the interruption port IB, and signal B is a drum clock signal input to the interruption port IB. FF (signal A) is reset by the rising of the signal B and inhibits the interruption into the port IB. The signal A, set by a reception instruction (step 3-3), is not reset until the rising of the signal B is detected. This also holds true of the port IA. The interruption port IA is for effecting an interruption process higher in so-called degree of priority than IB. A trouble detector is connected to IA and the aforementioned clock generator is connected to IB and therefore, when the trouble detector detects any trouble in the copying apparatus, the speaker 230 and indicator 225 can be quickly operated to provide a warning in the form of a statement corresponding to the place whereat the trouble has occurred, thereby stopping the operation of the copying apparatus.

That is, when F/F's of IA and IB are set and interruption signal is input to IA, F/F's of IA and IB are reset and the ROM program of the address designated by IA as previously noted is executed. Accordingly, the clock signal to IB is not received. On the other hand, when the clock signal is input to IB earlier, only the F/F of IB is reset. Accordingly, when a trouble signal is subsequently generated in IA, the trouble signal is entered to stop the copying apparatus in spite of interruption being applied to IB (inputting of drum clock CL).

Figure 7:
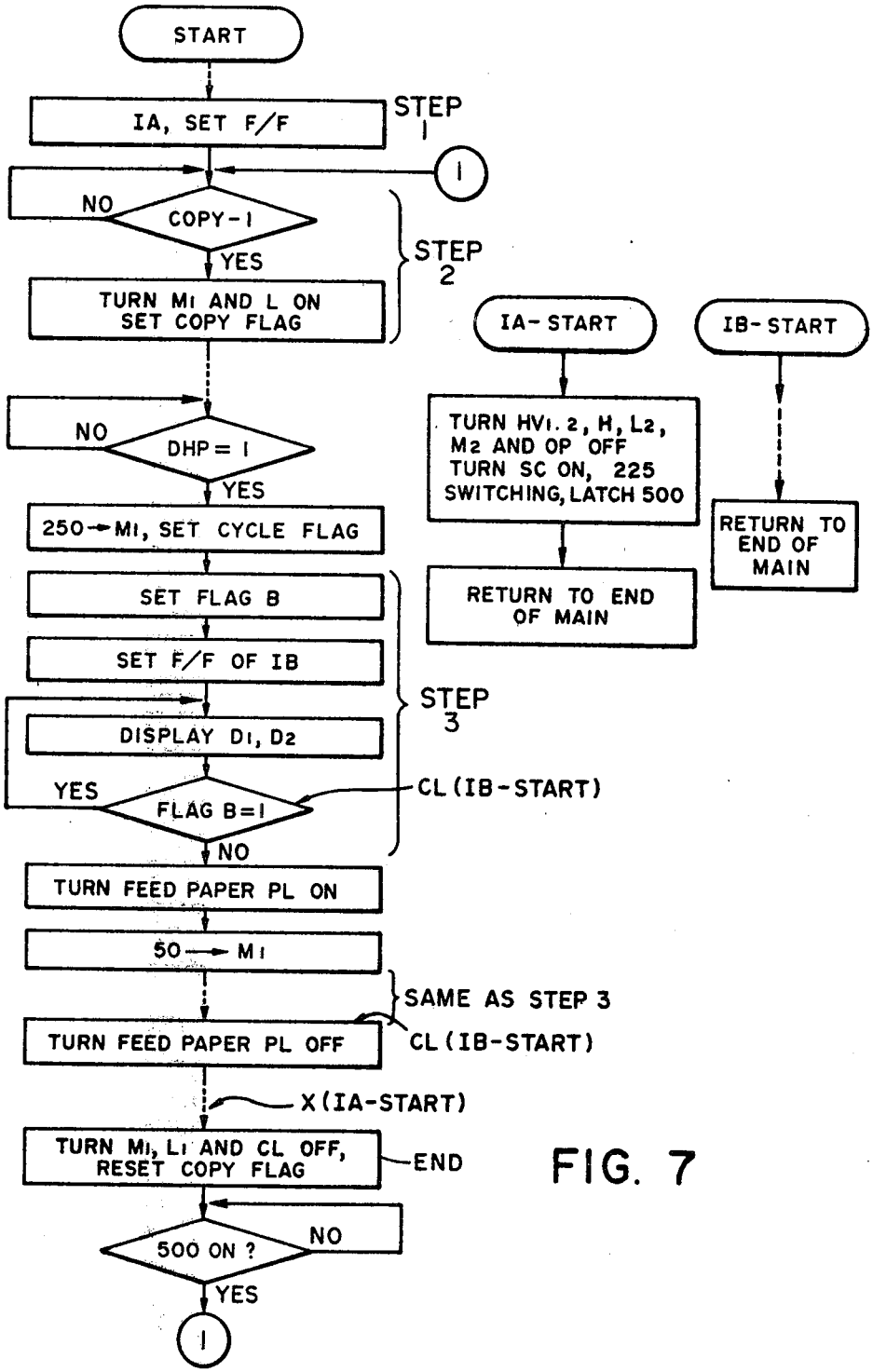
FIGS. 7, 8, 9, 10A, 10B, 10C, 11, 12, 13, 14, 15A, 15B, 16A, 16B, 19A and 19B are various abnormality detection control flow charts of the FIG. 4A circuit with FIGS. 10A, 10B and 10C being arranged as shown in FIG. 10 and with FIGS. 15A and 15B being arranged as shown in FIG. 15.

FIG. 7 is a flow chart in which when the closing of main switch SW is determined, F/F of IA is set by step 1 and at step 2, the depression of the copy key is determined and step 3 and so on for the aforementioned clock count are executed to terminate the copying process after a predetermined number of copies. At whatever step during this process cycle a trouble occurrence signal X may be generated, that step is interrupted and IA-START interruption flow is executed to deenergize the high voltage sources $HV_1$, $HV_2$, heater H, exposure lamp $L_2$, developing device $M_2$ and optical system OP, and the indicator 225 indicates E1 or the like to cause the speaker 230 to utter and cause the process cycle to shift to a termination cycle. The indicator 225 holds the indication of the then number of copies. Thereby, the operation of the copying apparatus (drum motor $M_1$, whole surface exposure lamp $L_1$ and various clutches CL) is stopped. After a safety measure against this trouble has been applied, by pushing back the actuating piece of reset button 500 so that copying can be restarted, the warning operations of the speaker 230 and indicator 225 are reset. It is also possible to reset these by determining the closing of a switch 501' operatively associated with a switch 501 which is operable in response to the opening of the housing door. In that case, the alarm indication by the indicator 225 is continued until the button 500 is depressed.

Now, IA flag is not reset as long as the switch SW is not opened and therefore, trouble monitoring can be done irrespective of the sequence or the non-sequence. When IA input is detected before the copy key ON is determined at step 2, the constant of the sound composite unit SC is controlled so that the speaker 230 utters at a sound volume lower by 3 dB as compared with a case where the IA input is detected during the time before the END step is reached.

When the IA input is detected before the CPU determines DHP, the speaker 230 is likewise operated to utter at a sound volume lower by 3 dB. Also, when the IA input is detected after the step END whereat a predetermined number of repeat copies has been finished is executed, the speaker is operated to utter at a sound volume lower by 3 dB.

When a trouble signal is input to IA during the cycle before the END step and the speaker 230 is latched to utter a statement repetitively, the END step is executed while, at the same time, the sound volume of the same statement so far uttered is reduced by 3 dB.

Instead of or with the above-described sound volume control, the repetition interval of statement can be prolonged or the sound quality, i.e., the substance of statement, can be varied.

This may prevent to the utmost the speaker's sound from providing annoying noise to others in the office.

Accident detecting circuits include, for example, a circuit 301 for detecting any abnormal temperature in the copying apparatus (in the fixing device), a paper firing detection circuit and detection circuits 300, 303 in exposure means. Such accident detecting circuits may also be provided by those for detecting the absence of transfer paper in the cassette and the absence of developer (23*a*, *b* in FIG. 1), or an external exclusive circuit for detecting a jam of transfer paper in the passage, or an external exclusive circuit for detecting erroneous feeding of paper from the cassette. Where the circuits for detecting paper jam or erroneous paper feeding are connected to the interruption port, it is preferable that by the generation of a detection signal indicative of a jam before the transfer station or erroneous paper feeding, the sequence is shifted to the post-rotation cycle immediately preceding the termination cycle, whereby the drum is stopped with its surface discharged, whereafter a sound alarm is effected. An example of the paper jam detecting circuit may be one in which a timer is operated upon start of paper feed and if paper detector 2 (FIG. 1) at the passage exit detects paper within a predetermined time (timer), the timer is reset but if the paper detector does not detect paper, the timer output is utilized as a detection signal, or one in which if paper does not completely pass the detector 2 within a predetermined time (another timer), the timer output is utilized as a detection signal.

Also, the erroneous paper feed detecting circuit may be one in which a timer is operated by paper feed and if a paper detector (not shown) provided near the paper feed roller is not operated within a predetermined timer time, the timer output is utilized as a detection signal or one in which oblique feeding of paper is detected and the detection signal is utilized as a signal.

The warning signal from CPU is information for the sound output circuit to generate a sound corresponding to the aforementioned abnormal operation. When SC of the sound output circuit receives said signal, two operations are effected. One is to access the characteristic parameters of an appropriate statement from ROM' 803 storing therein the characteristic parameters of statements to be uttered, on the basis of the signal from CPU. The characteristic parameters are obtained by band-compressing the sounds of statements, and refer to the parameters representative of pitch frequency, power spectrum, voiced sounds, voiceless sounds, amplitude, etc. On the other hand, in the SC which has extracted said characteristic parameters, digital information of statement sound is made on the basis of said characteristic parameters and by the use of a digital filter or the like, and such digital signal is sent to the subsequent D/A circuit 802. D/A is a D-A converter, which converts said digital signal into an analog signal, which is amplified by the next stage amplifier and put out to the speaker 230. Thus, the speaker puts out the sound of a statement based on said characteristic parameters. From this, it follows that the characteristic parameters, in other words, statements, stored in the ROM', can be freely set by the designer and for respective abnormality occurrence warnings, appropriate statements can be prepared so as to be well comprehensible to the user.

Figure 8:
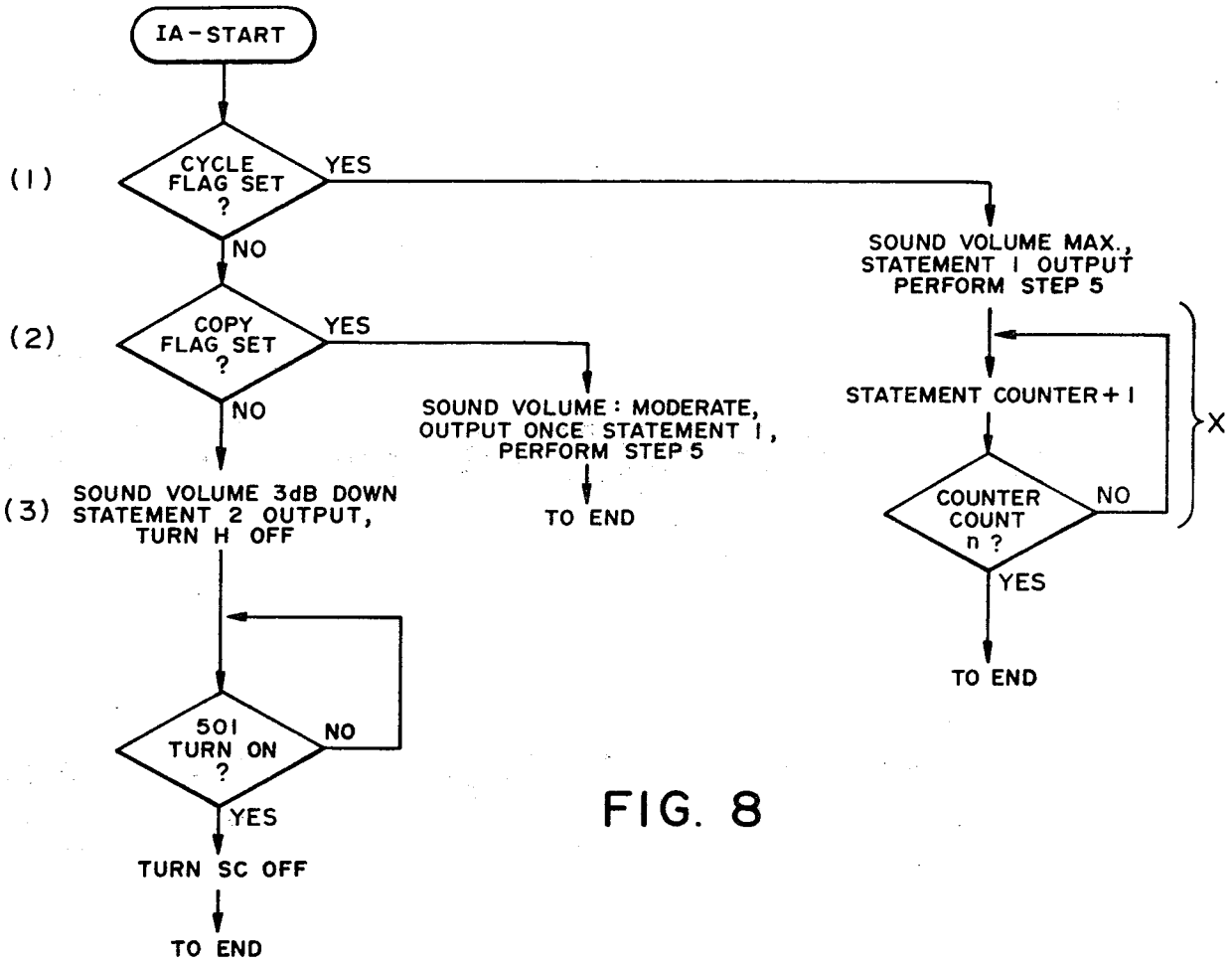
Figure 9:
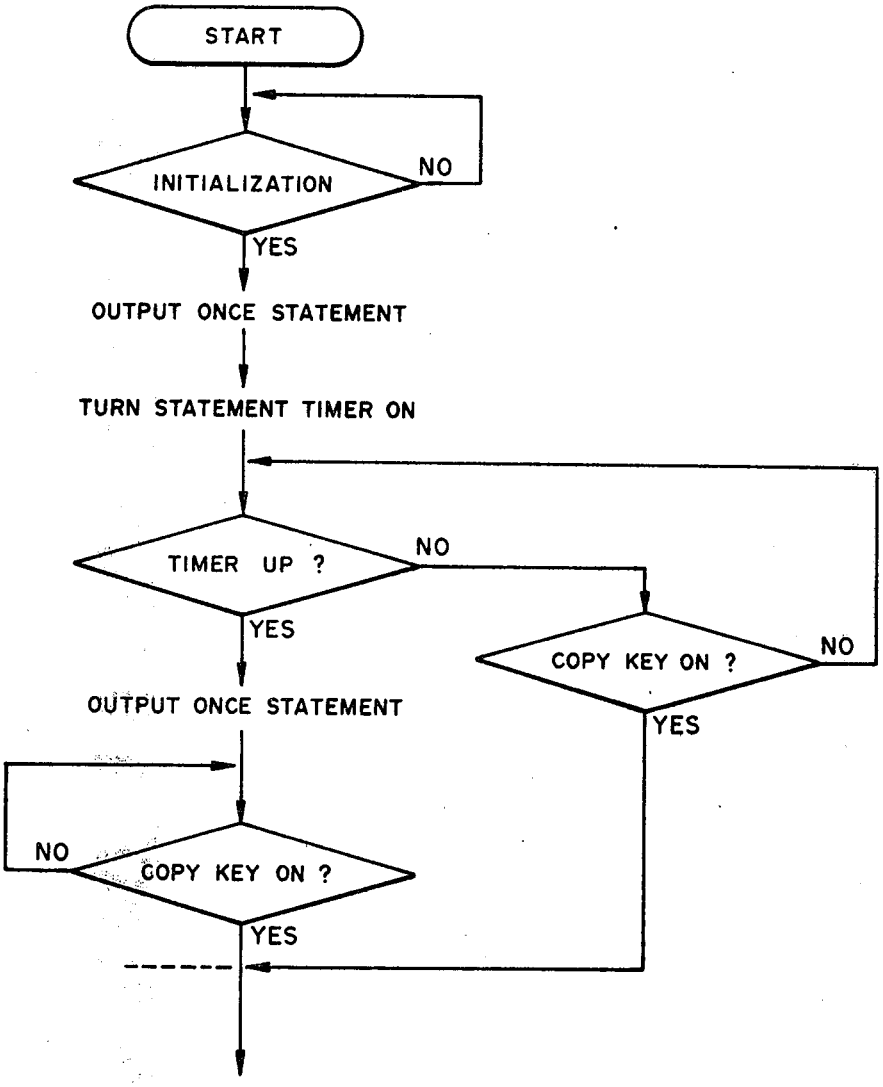

Now, when an abnormal operation is detected by the above-described copying process abnormality detecting means, CPU 800 puts out a signal for interrupting the copying process from the port $\theta_1$ by the program process as previously described, and further sends the signal to 801 of the sound composite unit SC to alert the operator. This signal also includes a signal representing a statement corresponding to the place whereat the abnormality has occurred, and a signal for instructing the increase of sound volume during the copy sequence and to decrease the sound volume before and after the copy sequence. Upon reception of such signal, the sound circuit effects the operation as previously described and the speaker 230 puts out the sound of a statement corresponding to the place whereat the abnormality has occurred and at a sound volume which is variable depending on the copy sequence, the cycle or before and after the copy sequence (FIG. 8). The sound circuit also generates a statement representative of the fact that copying operation can be started, immediately after the waiting time (FIG. 9).

FIG. 8 shows the control by the interruption program IA of FIG. 7. Assume that the lamp has become overheated. IA program is executed by the signal from thermistor 303. At step 1, a cycle flag indicative of the fact that the image formation process sequence is going on is determined. This flag is an area of RAM which is set at the DHP determination step of FIG. 7 and reset by the OHP detection of the optical system stoppage in the last cycle at the termination of a predetermined number of repeat copies. That is, it corresponds to the time zone except the pre-process rotation and post-process rotation of the drum. Those process rotation times correspond to several revolutions of the drum necessary for the whole surface cleaning and discharging. When the input to IA is detected in any zone except these, a suitable statement is uttered at a predetermined sound volume. When a statement is uttered once, a statement counter provided in the RAM is incremented. When a statement output is repeated a predetermined number of times, the output from CPU 800 to the sound circuit 801 is cut to stop the utterance. A short warning is given at such a great sound volume that can call everybody's attention. The CPU creates no other program interruption during the sound execution and therefore, sound generation can be effected properly.

During the time other than the cycle, a copy flag is determined (step 2). This flag is set in another area of RAM when the depression of the copy key 221 is determined, and is reset when the END step of FIG. 7 is reached. Accordingly, when the setting of this flag is determined, an accident is regarded as having occurred during the pre- or the post-rotation and the same statement is uttered once at a sound volume lower than that within the cycle. This is in consideration of the fact that the operator keeps close to the machine.

Next, when a trouble occurs during a condition in which the copy flag is reset, namely, in the zone of stand-by or wait, utterance is repetitively effected at a sound volume lower by 3 dB than that during the cycle and moreover in the form of a different statement, as at step 3. Then, the output of the sound circuit 801 is latched so that it is put out a predetermined number of times until a door switch 501 is opened. Thereby, the trouble condition may be recognized even if the machine is left at a deserted place with the switch SW remaining closed and with the machine remaining in stand-by condition. This also holds true when disconnection of the lamp has been detected by sensor 303, and in such case, a statement which can identify the trouble is uttered. The detection signal indicative of the aforementioned trouble of the optical system clutch OP is also input to IA to enable such trouble to be similarly dealt with.

In FIG. 9, a wait mode until the fixing heater reaches a fixing capable temperature is provided at step 1 after the closing of the switch SW so that copying cannot be started during that time. When the waiting time occurs in accordance with the signal from sensor 301, a suitable statement is put out and a statement timer provided in the RAM is turned on. This timer determines the repetition output period by counting a predetermined number of microclock pulses which cause the CPU 800 to run. At count-up, the same statement is again put out. When the copy key is depressed in the meantime or thereafter, the copy cycle of FIG. 7 is entered. By this, it can be taught at a necessary minimal sound volume that copying can be started. The number of times of the utterance therefor may be one.

Control corresponding to the object or place to be detected will now be described with reference to the flow chart of FIG. 10. First, when an abnormal operation is detected during the copying process, the detection signal is input to the port IA, and in this case, 1 of the abnormality detection flag is set. This abnormality detection flag is fully monitored by the program with the drum clock or the like of the copying apparatus as the timing signal.

When it is detected that the abnormality detection flag has become 1 (step 1), the program branches off from the copying process routine and judges whether the abnormal operation is A or B (steps 2 and 3). This judgement is effected by the bit check of the IA port (4 or 8 bits). The abnormal operations A and B are ranked in accordance with the degree of danger. The abnormal operation A means a trouble having a very high degree of danger and refers to a trouble such as, for example, a jam near the fixing heater, overheating of the heater, or twining of paper around the drum. The abnormal operation B means a trouble having a low degree of dangerousness and refers to erroneous paper feed, jam near the image transfer station, overheating of the platen, or the like. Accordingly, the abnormal operation A can be recognized by determining 1 of the bit to which sensors 2 and 301 are connected, and the abnormal operation B can be recognized by determining 1 of the bit to which the other sensors are connected. The operations of interrupting the copying process are made to differ from each other depending on the abnormal operation A or B. For example, when an abnormal operation is detected by an abnormality detecting circuit ranked as the abnormal operation A, the units such as the fixing heater, the drive motor, the high voltage source, etc. are all disconnected at the interruption routine of the copying process because such abnormal operation is very dangerous. Also, when an abnormal operation is detected by an abnormality detecting circuit ranked as the abnormal operation B, the fixing heater, etc. are not disconnected because such abnormal operation is not so dangerous, and the copying process will be stopped after a post-process for the process stabilization has been carried out. When the abnormal operation A is detected, the input of the copy key is not received as long as the reset button 500 is not depressed, whereas when the abnormal operation B is detected, copying becomes possible if the abnormal condition is repaired.

Figure 10:
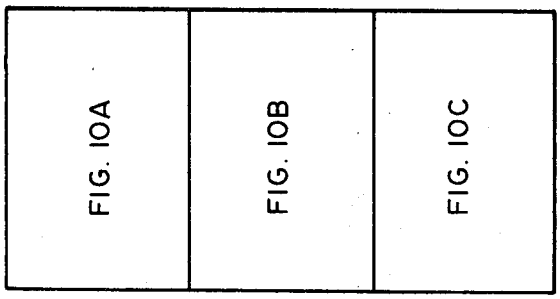
Figure 10A:
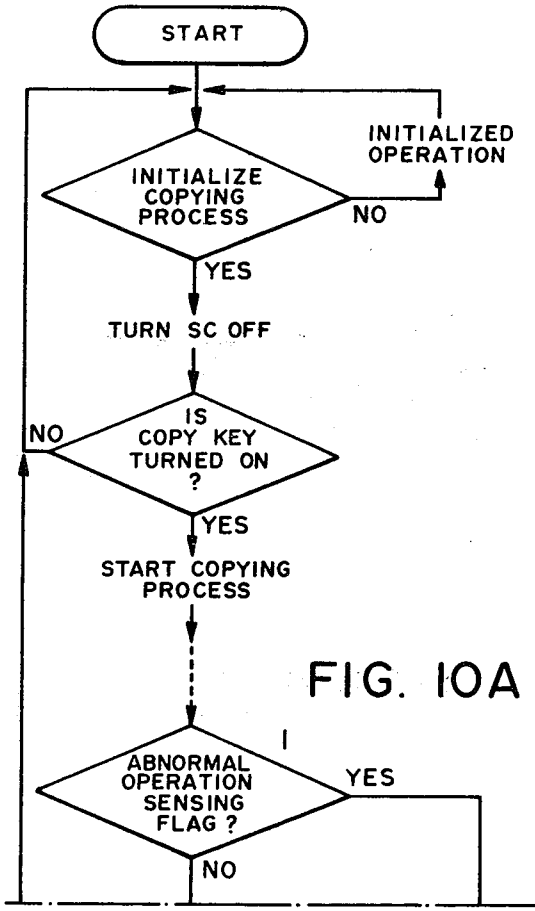

In FIG. 10, when judgment as to whether an abnormal operation is A or B is effected and thereafter the abnormal operation is judged as A, judgment as to which one of the abnormality detecting circuits has detected the abnormal operation is further formed by the aforementioned bit determination after the interruption routine of said copying process has been done. If an abnormal operation is detected and it is judged as overheating of the fixing roller, the sound of statement 1 corresponding thereto is repeatedly put out and E1 is indicated on the segment indicator 225. Since it is abnormal operation A, the sound volume is high. The sound output is latched until the opening of door switch 501 is detected. Depression of reset button 500 is detected and the indication by the indicator 225 is returned to the indication of the number of sheets. For any other operation than said abnormal operation, a similar action takes place and the indicator 225 indicates E2 thereon, but since this time the abnormal operation is overheating of the lamp or a jam at the image transfer station, the sound latch is cancelled by a clear key or a stop key.

B is not so dangerous and so, the sound volume thereafter is made lower by 3 dB. In the case of detection 2, a statement is repeated a predetermined number of times and then stopped, but in the other cases (absence of toner by 302, etc.), statement is put out with the statement interval lengthened. Detection 2 includes absence of paper, absence of cassette and overheating of platen.

The above-described step 1 and so on may be provided in the routine before the start of copying to ensure check-up.

The use of the above-described alarm means using sound, as compared with the conventional indication means using light, enables the operator to be more reliably alerted of any abnormality in the copying process.

Figure 11:
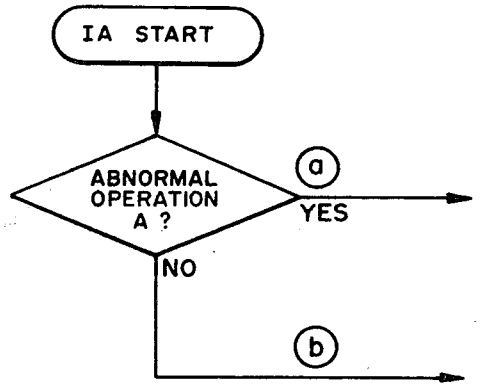
Figure 10B:
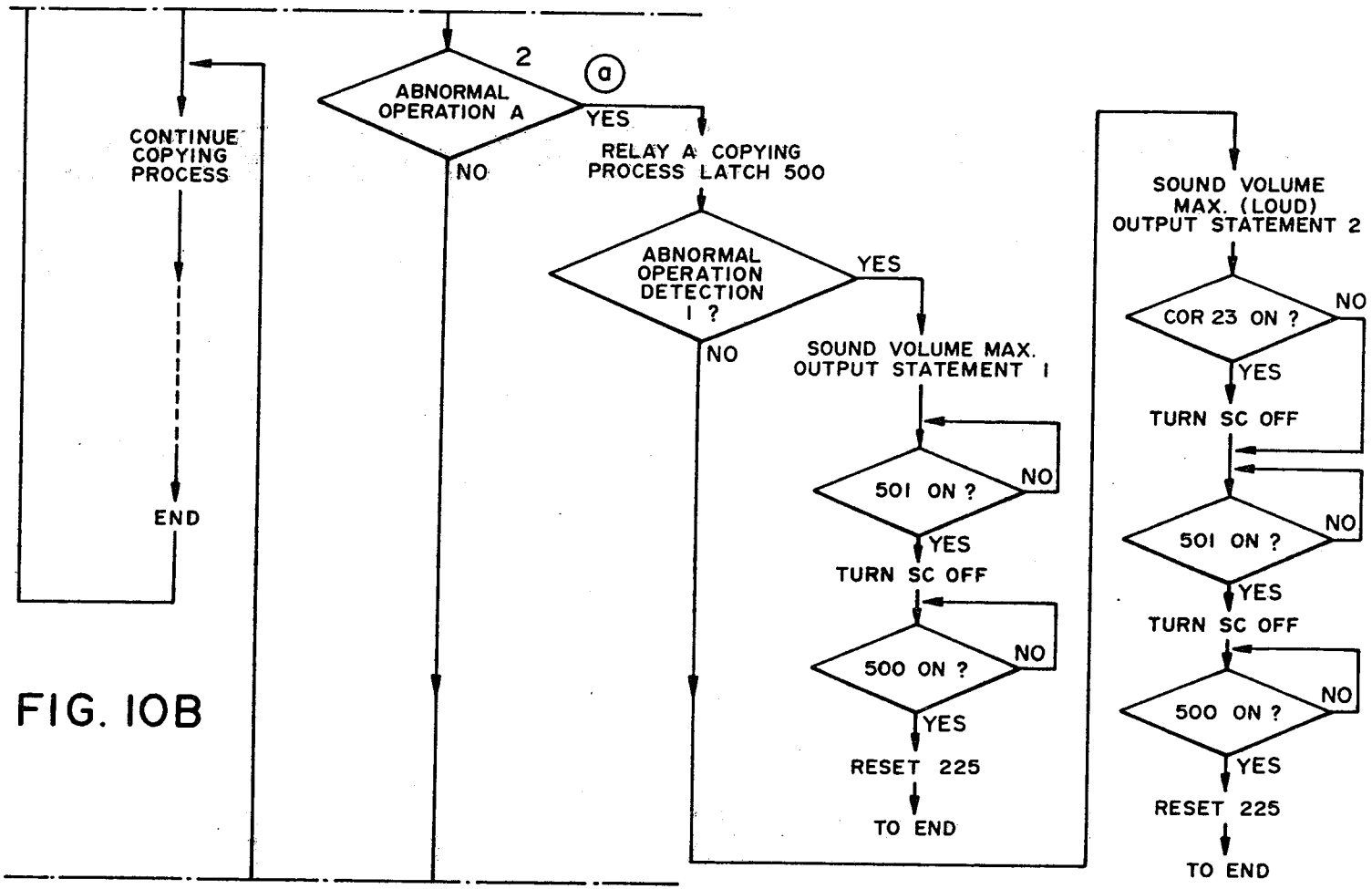
Figure 10C:
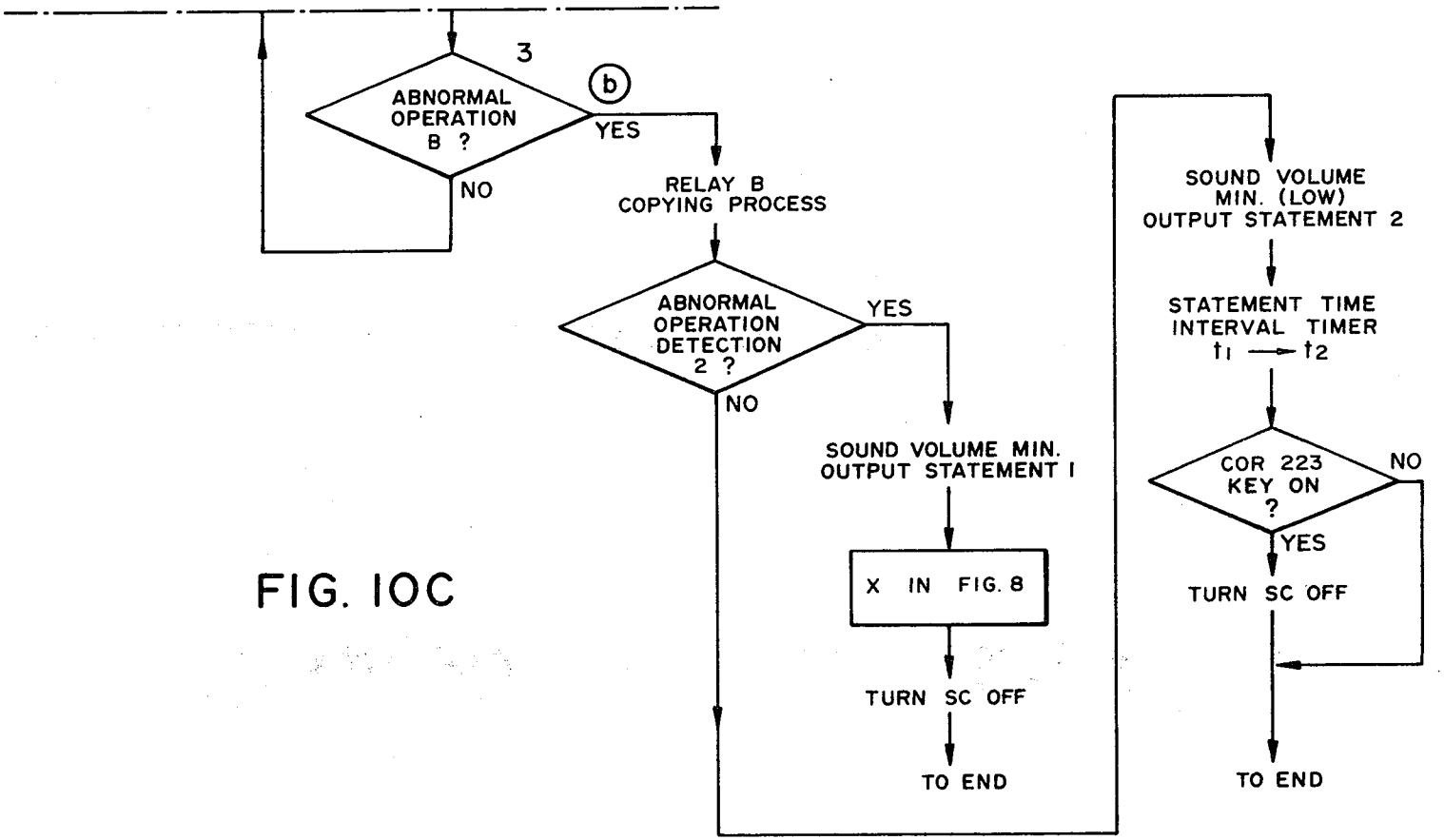

FIG. 11 shows an example using an interruption port in which any signal from each sensor causes the program to jump to the flow as shown in FIG. 7, whereafter the determination as previously described is repeated.

In the event of abnormality of a low rank, a monotonous acoustic wave (for example, continuation of 1 KHz) may be employed. CPU operates the speaker 230 by depression of keys 221–224, 231–233, but in the event of a trouble of a low rank, it can render the sound to the same level as that during this key depression.

Figure 12:
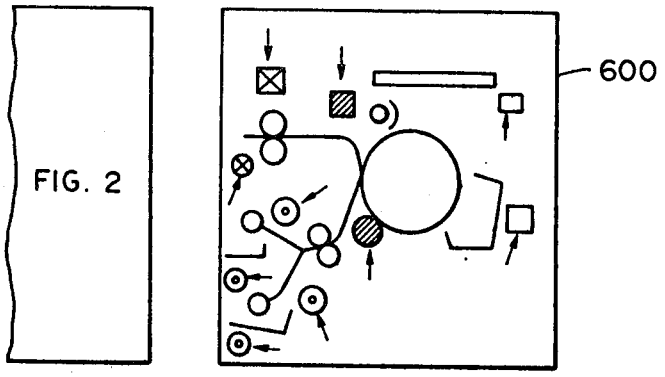

Description will now be made of LED indication and alarm means using sound. As shown in FIG. 12, in the indication plate 600 of FIG. 2 wherein a schematic view of the copying apparatus is depicted, different LED's of different colors corresponding to the ranks of abnormality are mounted at places corresponding to the positions whereat the abnormality detecting circuits are installed. From CPU, a signal which will cause the LED corresponding to the position whereat an abnormal operation has been detected to emit light is put out to the port $\theta_2$, whereby the LED is turned on. Further, to help the operator perceive an abnormal operation, LED of high rank (detection 1 of FIG. 10) is turned on and off. Each segment of 7-segment LED's 224, 226 or the pattern of the 7-segment LED 225 and the LED of FIG. 12 are made to correspond to the abnormal portion and they are turned on and off at the same time as described above. The LED of FIG. 12 corresponds to each sensor position of FIG. 1.

Figure 13:
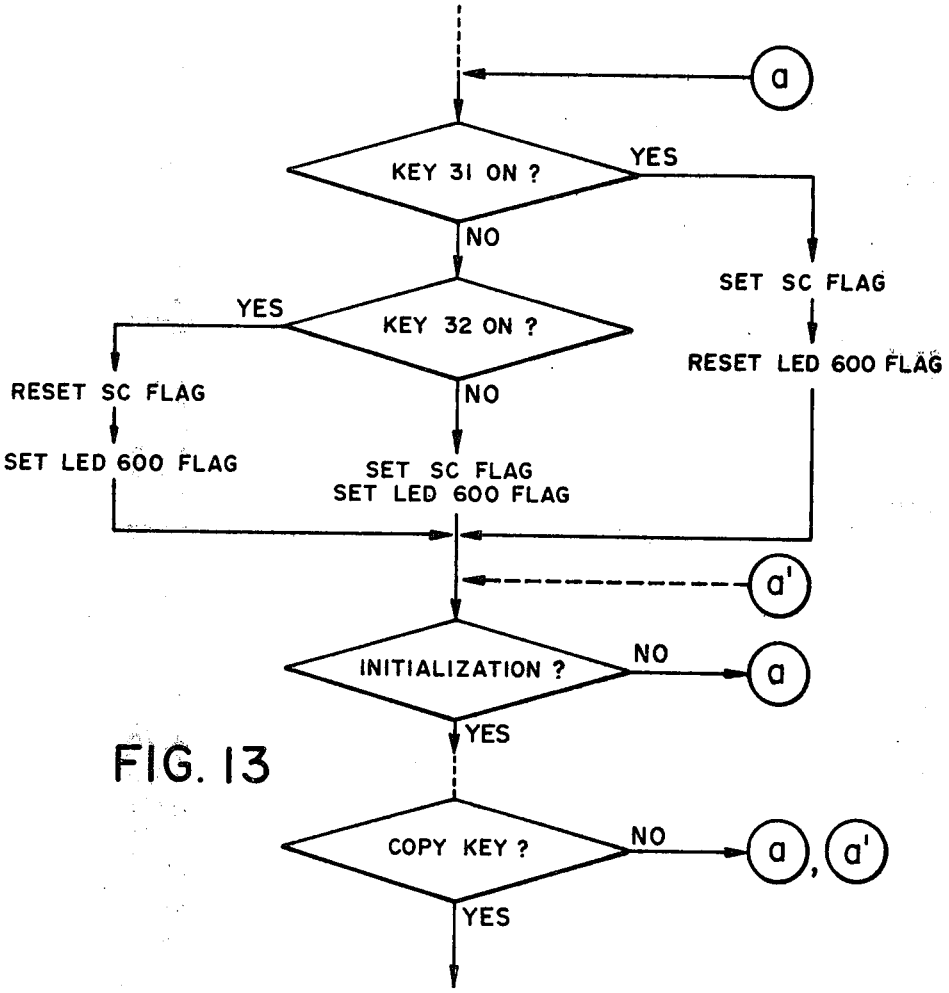

In FIG. 13, after the closing of switch SW, when key 231 is depressed during the initialization such as the aforementioned wait, cleaning rotation or resetting of the optical system to OHP, the SC flag alone is set and sound alone is selected. When key 232 is depressed, LED alone is selected. The initialization routine receives the key entry such as ten-key or the like. By the depression of the keys 231 and 232 the SC flag and LED flag are set in the RAM. If no key is depressed, both are set. Change of the flags is effected by the clear key.

Figure 14:
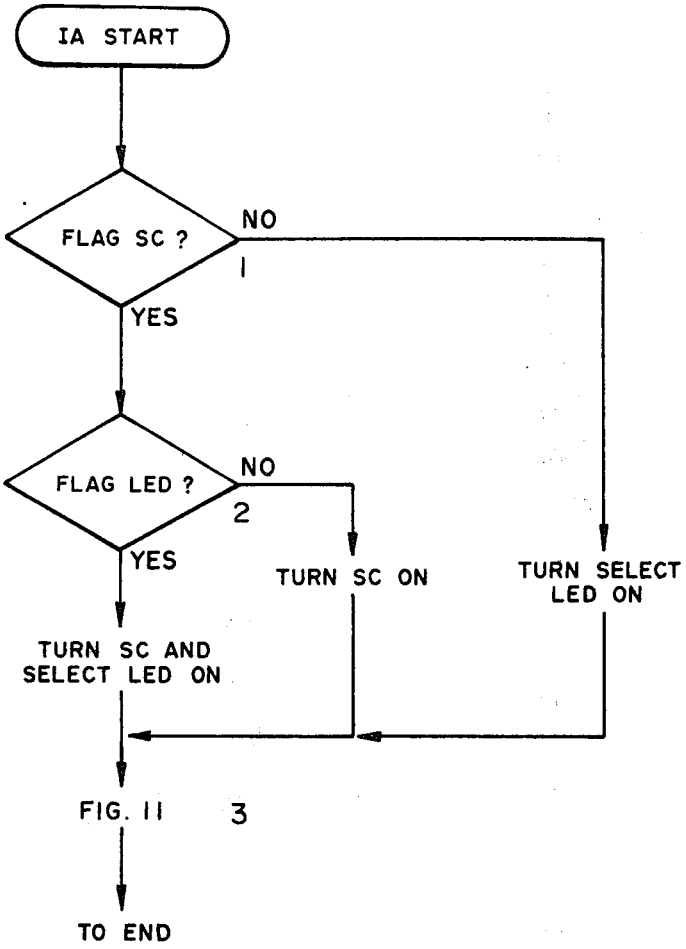

Next, the flow of FIG. 14 is executed by inputting a trouble signal, as previously described. First, whether a sound ouput or an LED indication output should be provided as an alarm is judged. This is effected by determining the previous flag (steps 1 and 2). When the flag SC set is the LED flag reset, a sound ouput is selected and therefore, an appropriate signal is sent to the sound composite unit SC. The sound composite unit carries out the process as previously mentioned, and a sound in the form of a statement and at a sound volume corresponding to the place whereat the abnormality has occurred or corresponding to the machine condition is put out from the speaker 230. A similar process is also carried out in the LED indication means (step 3). These flags are directly re-set by a key for each series of copies. That is, the two flags are automatically set upon termination of desired copying. Alternatively, when the program returns to a' during determination of the copy key, it is possible to re-set the flags by the use of the clear key.

As described above, the provision of alarm means using LED indication and alarm means using sound output leads to the advantage that these alarm means can be used properly depending on the operator's choice or the environment in which the machine is used.

Figures 15, 15A, 15B:
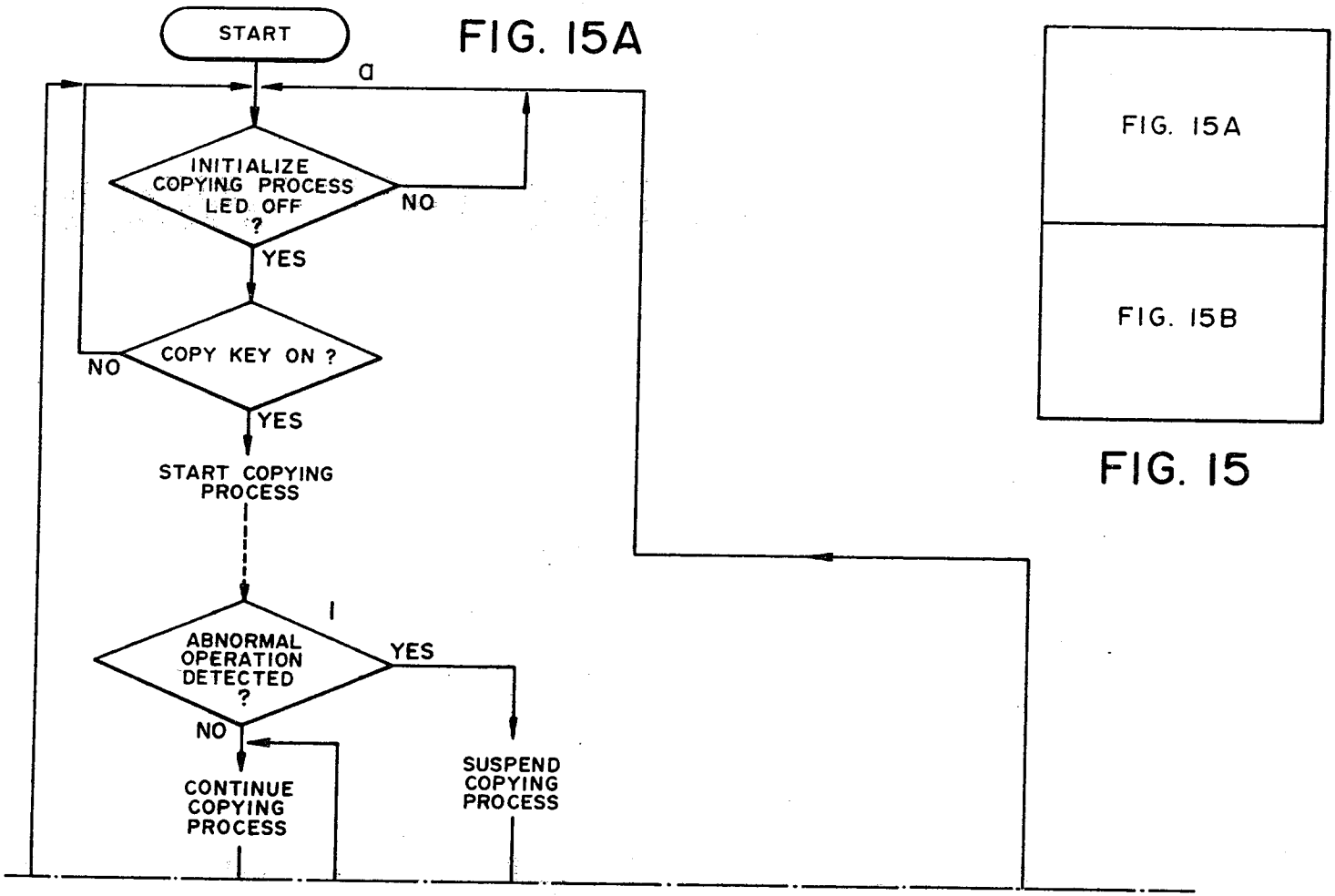
Figure 15B:
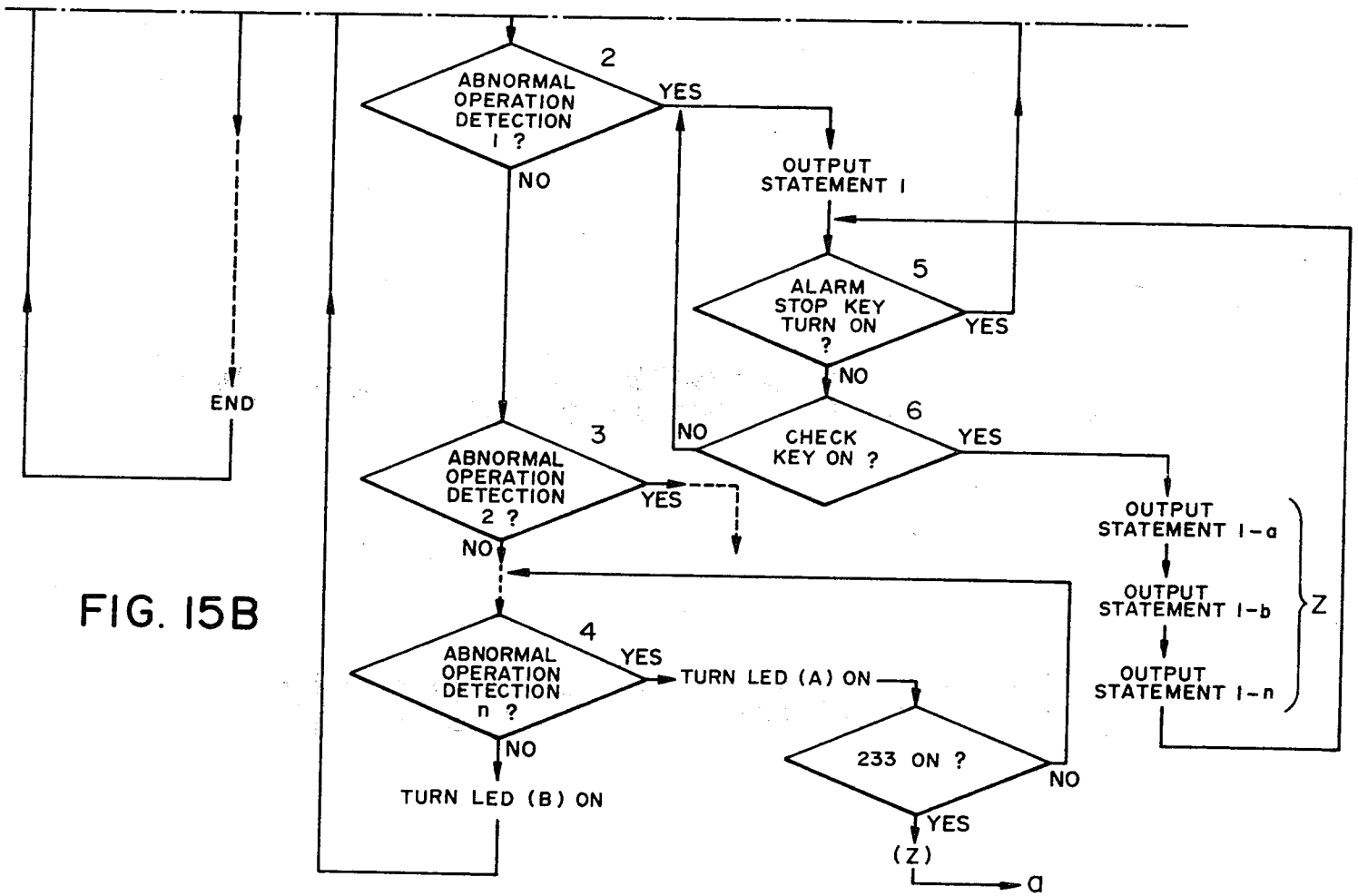

FIG. 15 is a flow chart showing the sound control in the abnormality treating procedure by check key 233. A trouble is judged in the previously described manner and the input port $I_2$ of the microcomputer is periodically sensed to periodically determine the machiine condition such as absence of cassette (step 1), whereafter the kind of the trouble is determined (steps 2–4). The result is put out from the speaker. Thereafter, whether the clear key C for stopping the alarm has been depressed is judged (step 5). Whether the abnormal operation has been released by the alarm stop key is also judged. If the abnormal operation has been released, the program returns to step a for stand-by and, if not so, the program proceeds to step 6. If the alarm key C has not yet been depressed, whether the check key 233 has been depressed is checked (step 6). The check key 233 is for indicating a method of dealing with an abnormal portion when how to deal with a place whereat an abnormal operation has occurred is unknown. When the check key is depressed, the alarm so far indicated is stopped and CPU sends signals to the sound output circuit SC to orally put out treatment procedures. In the Figure, statement 1-a, statement 1-b, . . . statement 1-n are these signals. For example, in the event of erroneous paper feed, different statements such as "take a cassette", "isn't paper jamming?", etc. are successively put out in the form of sound at predetermined intervals. Also, abnormality is taught at different sound volumes and at different intervals depending on the place whereat the abnormality has occurred. The above-described operation similarly takes place in every abnormality detection. In the case of trouble n, LED alone is turned on and no sound output takes place, but the treatment procedures can be uttered by means of this key 233. LED(B) can also provide the above-described teaching routine if Y of step 5 is replaced by N even after the sound has been stopped by the clear key corresponding to TEP.

Unnecessary sound teaching can be prevented by this. Each time the check key is depressed once, one or two teachings are effected and it is preferable that the same statement not be repeated three times or more. Also, each step of routine Z detects when the cassette has been withdrawn or the door has been opened, and utters once what should be done next. Even if a jam is not occurring, but if the door is opened while the power source is ON in the machine, it is detected and "open" is uttered once.

Figure 16A:
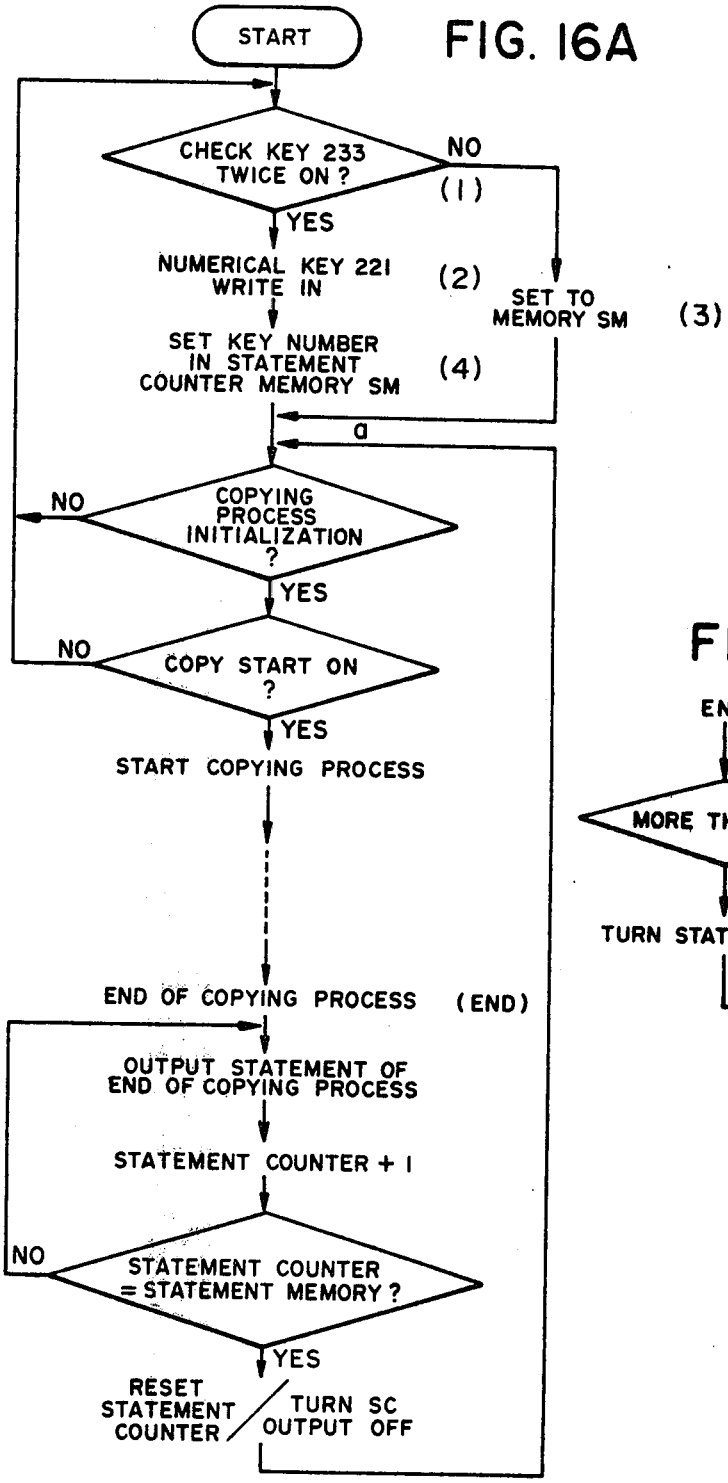
Figure 16B:
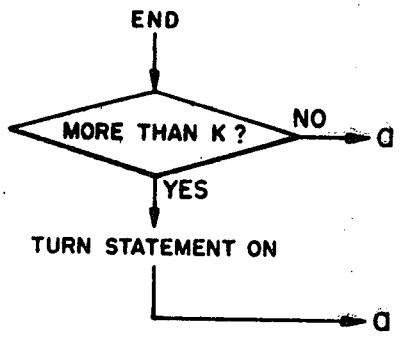

FIG. 16 shows a control in which the same statement is repeated a predetermined number of times and then automatically stopped and that number of times is arbitrarily preset by ten-key 221.

First, at END step whereat the copying process has come to an end, to put out a statement representative of the termination of copying, such as "copying has been finished" or the like, a signal having the information of said statement is put out from CPU to the sound output circuit SC. Then, the statement counter of the RAM is incremented to count the number of times of outputting of said signal. This counted number is compared with the preset number in the counter memory (this number is contained in the statement counter memory area of the RAM by the ten-key 221 at step 2). If the counted number is smaller than the preset number, sound is again put out and, if the counted number becomes equal to the preset number, the sound is stopped and the counter is reset to return to the process initialization, whereby abnormality is eliminated and the program waits for a routine for monitoring the copy start key, namely, the copying becoming possible. Setting a number in the counter memory SM may be accomplished by depressing the check key 233 twice on end and depressing the ten-key 221. When the key 233 is not depressed but the copy key has been depressed to start copying, the n contained in the ROM is automatically set in the counter memory. This is applied not only to the end of copying but also to every statement output which informs of the ready-to-copy condition. Wrong inputting of the repetition number can be corrected by depressing the check key 233 again. Change of the number after the termination of the sequence of a set number of copies may also be accomplished in a similar manner. Correction may also be accomplished by using the clear key C.

In a similar manner, the length of the timer which determines the repetition interval of the same statement can also be preset by the ten-key. The sound continuation time can be determined by using a timer instead of a counter.

If the utterance "copy end" is effected once only when a desired number of copies K is exceeded, noisiness will be reduced. It is carried out by the flow of FIG. 16B.

A signal may be input to CPU so that the total number of copies not cleared is counted externally and when that number reaches a predetermined number, the photosensitive medium is replaced by a new one, whereby oral warning may be effected by the IA program.

Now, breakage of corona discharge wire or abnormality of the high voltage source resulting from breakdown of transistors or the like usually may not exist at a location which is perceptible to the sight or other sense of the operator and moreover, there are plural types of abnormality of the same subject which will often bring about more than a little damage.

Figure 17:
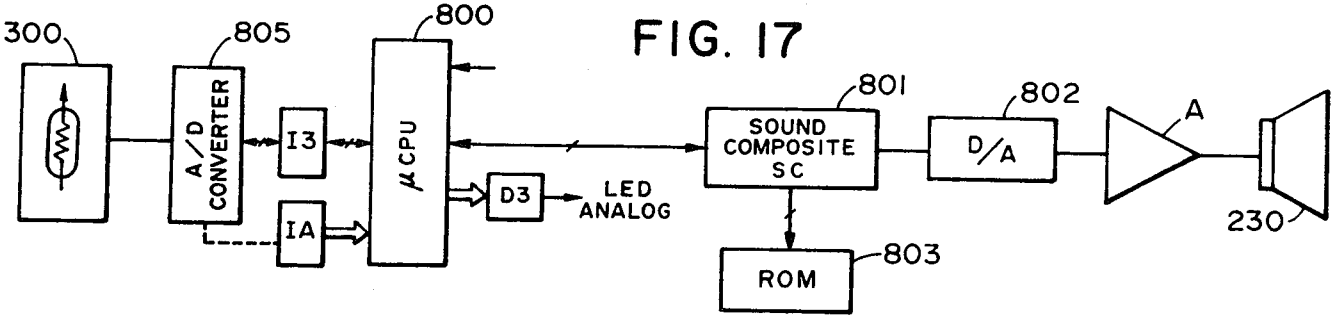
FIG. 17 is a diagram of another control circuit.

FIG. 17 shows a circuit arrangement which enables an appropriate measure to be taken in accordance with each of plural types of abnormality. For example, in a case where the temperature of the fixing heater is to be controlled to a constant level by thermistor 300, there may occur various types of abnormality such as abnormal voltage or shorted thermistor. Accordingly, detection is input to the microcomputer 800 through a converter 805 which decodes and sends a signal to each line of input port I3 in accordance with the type of the abnormality. The converter 805 is a kind of A/D converter which converts a signal so that signal CPU 800, indicative of various types and degrees of abnormality obtained by sensor 300, can be decoded. CPU 800 effects the comparison with a certain predetermined reference value and if it judges the situation as abnormal, it puts out to the sound composite circuit SC a signal corresponding to each individual type of abnormality.

Figure 18:
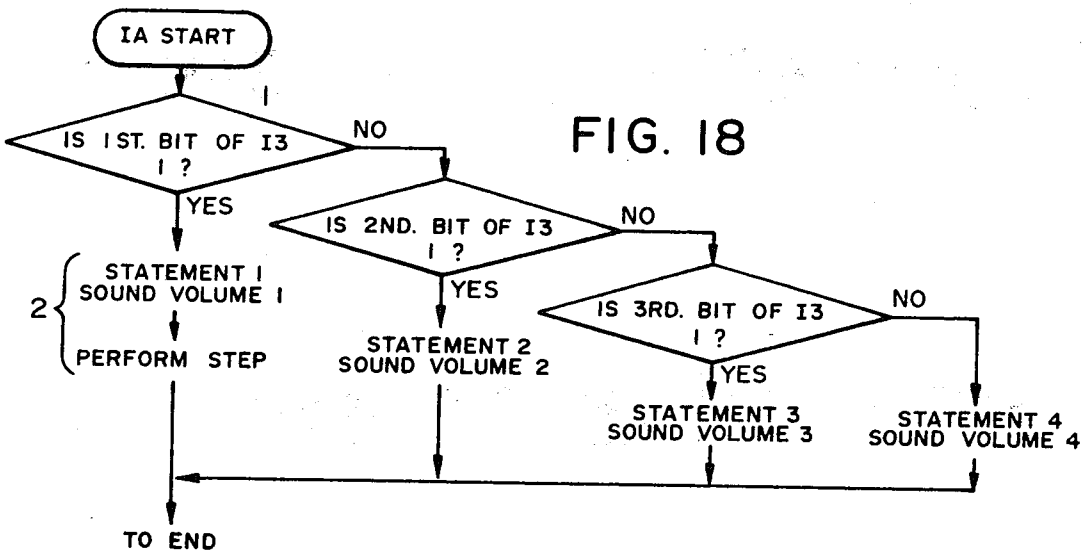
FIG. 18 is a control flow chart of the FIG. 17 circuit.

FIG. 18 is a control flow chart thereof. This chart is a case wherein design is made such that 1 is set in one of 4 or 8 bits of the input port by the converter 805 in accordance with the type of abnormality detection signal. That is, when it is sensed that 1 has been set in one of the bits of input port I3, the program jumps to the IA flow of FIG. 18 through interruption port IA. When the input port I3 is sensed to determine that 1 is set in 1 bit thereof (step 1), it is regarded as a dangerous abnormality 1 and a statement to that effect is repetitively uttered at a very great sound volume to stop the machine (step 2). When 1 of 1 bit, 3 bit, . . . has been determined, statements 2, 3, . . . are uttered at a sound volume lower by 3 dB and at greater repetition intervals. A number of LED's may be arranged so as to indicate the degree of abnormality and may be turned on in synchronism with said abnormality determination so that the number thereof may be selected.

In FIG. 19, when the main switch of the copying machine is closed, initialization of the copying process including the resetting of the power source circuit and the pre-rotation of the drum is effected (step 1). Confirmation means which gives a sound in this condition before copying is started is provided for anyone who has never used a copying machine. That is, when the operator depresses the check key 233 provided in the operating portion of FIG. 2 in said condition before copying is started, it is judged (step 2) and the program branches off into routines 3 and 4 of statement output. Statements as indicated by statement p-a, statement p-b, . . . are then orally put out. That is, when the check key 233 used during abnormality is depressed before copying is stated, statements such as "Have you set the number of copies?", "Have you designated the size of paper?", etc. are successively put out from the copying machine (step 4). If the preparations for copying have already been made or after step 4 has been executed, the check key 233 is again depressed, whereby a statement that "depress copy key" is put out (step 3). Similarly to the case where abnormality is dealt with, the utterance takes place once or twice each time the check key 233 is depressed.

Figures 19A, 19B:
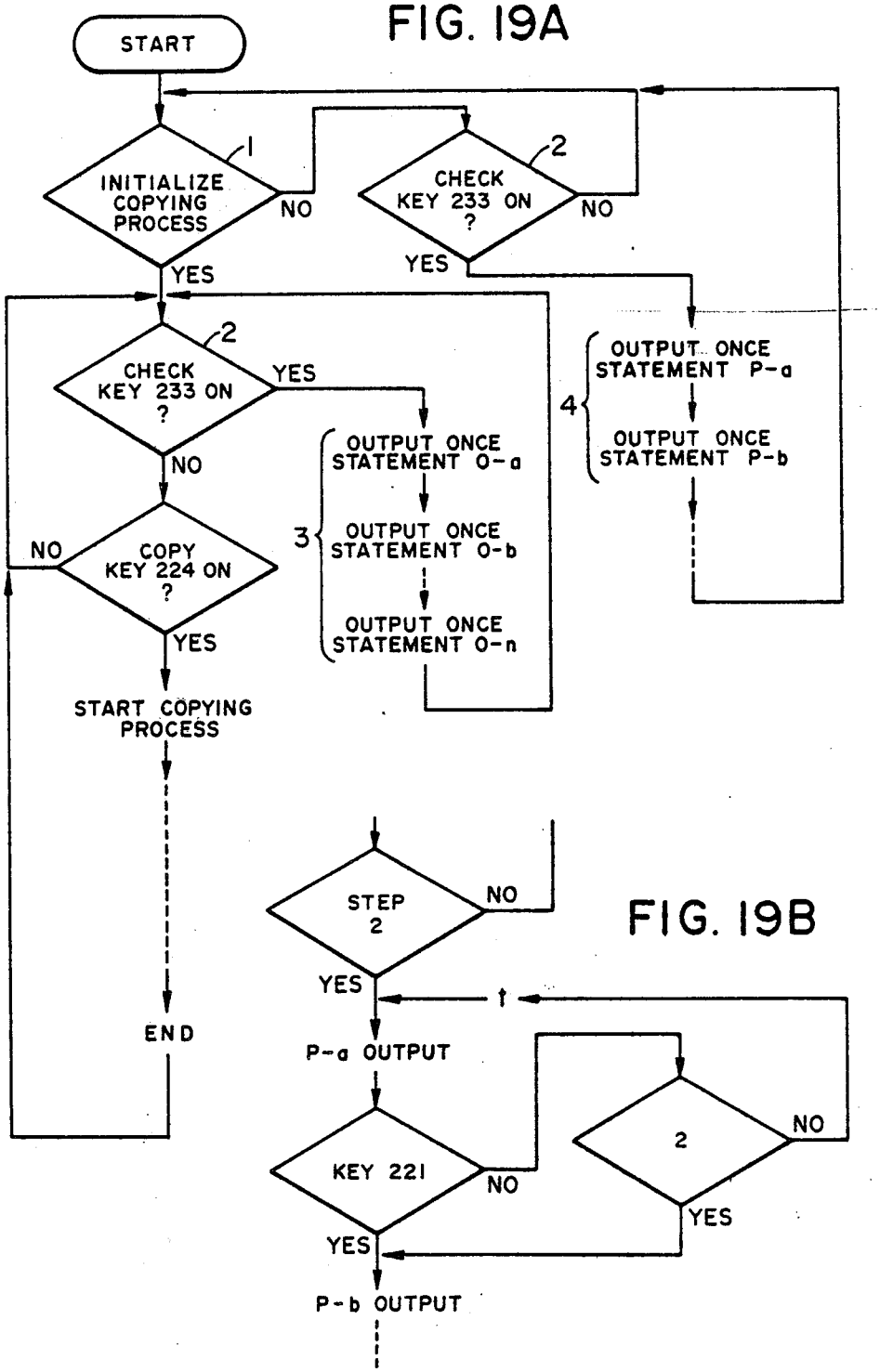

In FIG. 19B, when statement P-a regarding the number is put out once by depression of guide key 233 (which also serves as the check key), the program waits for ten-key 221 to be operated. Only after the ten-key has been operated, statement P-b regarding the size is put out once. If the ten-key 221 is not operated within a predetermined time t, statement P-a is again put out, and then statement P-b is put out.

FIGS. 19A and 19B can very much facilitate the operation of variable magnification copying machines, color copying machines and copying machines capable of trimming.

In each of the foregoing and following examples, in order that statements may be uttered in either Japanese or English, the sound data thereof are pre-stored in the ROM' of FIG. 4A and arranged so that they can be selected by a change-over switch, not shown, as desired. Further, an exclusive key switch for causing warning statements, guide statements or words to be put out for utterance diagnosis may be provided in the machine. During the sound utterance by this key, copying cannot be started even if the copy key is depressed.

Also, in the present example of the copying machine, an earphone jack 900 may be provided so as to be particularly effective in FIGS. 15 and 19 and when an earphone is set to the jack 900, a statement of a jam treating procedure or copying operation procedure can be put out from the earphone alone without the speaker being operated. This may prevent noisiness.

Figure 20A:
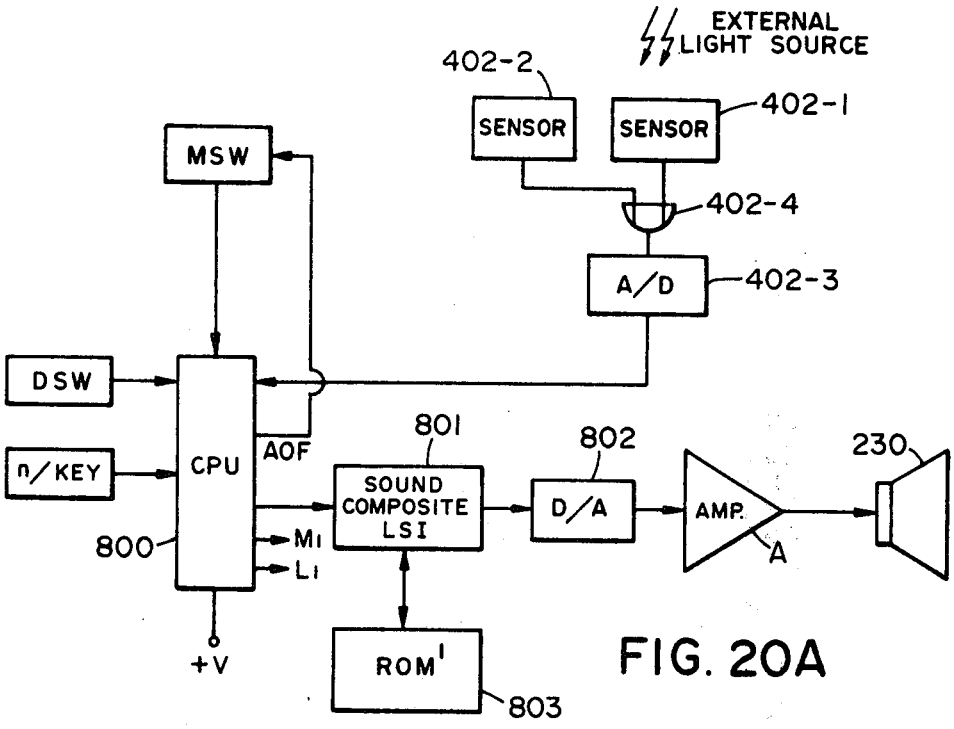
FIG. 20A is a diagram of power source cut-off forget warning circuit.

FIG. 20A shows an arrangement for preventing one from forgetting to cut off the power source of a copying apparatus or the like.

This example can also prevent one from forgetting to cut off the power source of facsimile or other electric instruments such as driers, washing machines, etc. or the power source for illumination of automotive vehicles.

The following example is one in which statement sound is generated, but a similar construction may be adopted in a case where a simple alarm sound such as a buzzer is generated.

Figure 20B:
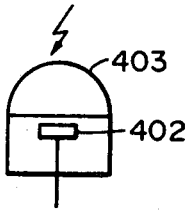
FIG. 20B shows a sensor.

In FIG. 20A, MSW designates a main switch for rotating a main motor or the like as required to operate the copying machine, and DSW denotes a switch adapted to be closed and opened by opening and closing the housing or the original cover 10 of the copying machine of FIG. 1. Where DSW is a door switch, the opening thereof results in turn-off of the high voltage, etc. Computer 800 (FIGS. 4 and 20) is so designed that the power supply thereto is not cut off even if the switches MSW and DSW are opened. Reference numeral 402-1 designates a photosensor such as a phototransistor for detecting the ambient brightness around the copying machine, and the output thereof is variable in accordance with the intensity of the brightness. Elements designated by the other reference characters are the same as those shown in FIG. 4. When one forgets to cut off the power source, CPU puts out, in synchronism with the sound generation timing, an address data which selects the statement data therefor from the ROM'. In the present example, "Open power switch" is uttered as sound 1 and "Power switch has been opened" is uttered as sound 2 .

Figure 21A:
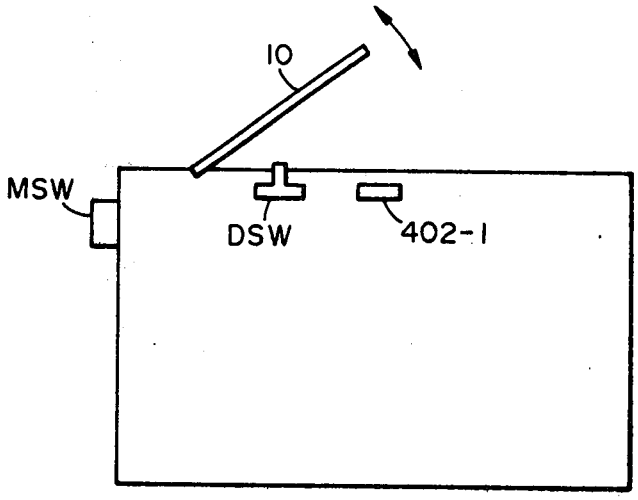
FIGS. 21A and 21B show the arrangements of switches.
Figure 21B:
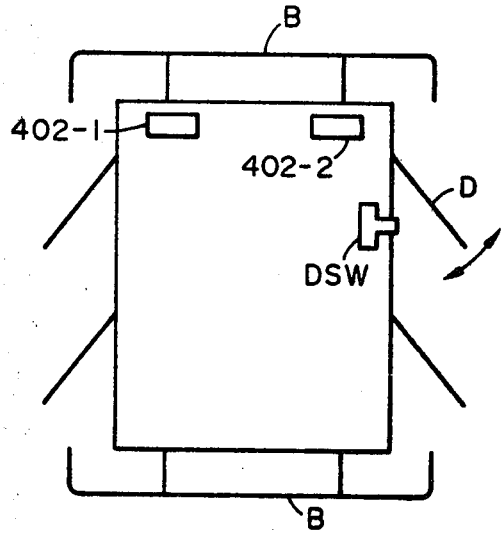

FIG. 21A is a front view of the copying machine showing the arrangement of switches MSW, DSW and sensor 402-1. Designated by 10 is an original cover. FIG. 21B shows a hemispherical transparent glass 403 provided to enhance and make non-directional the sensitivity of sensor 402-1.

Figure 22:
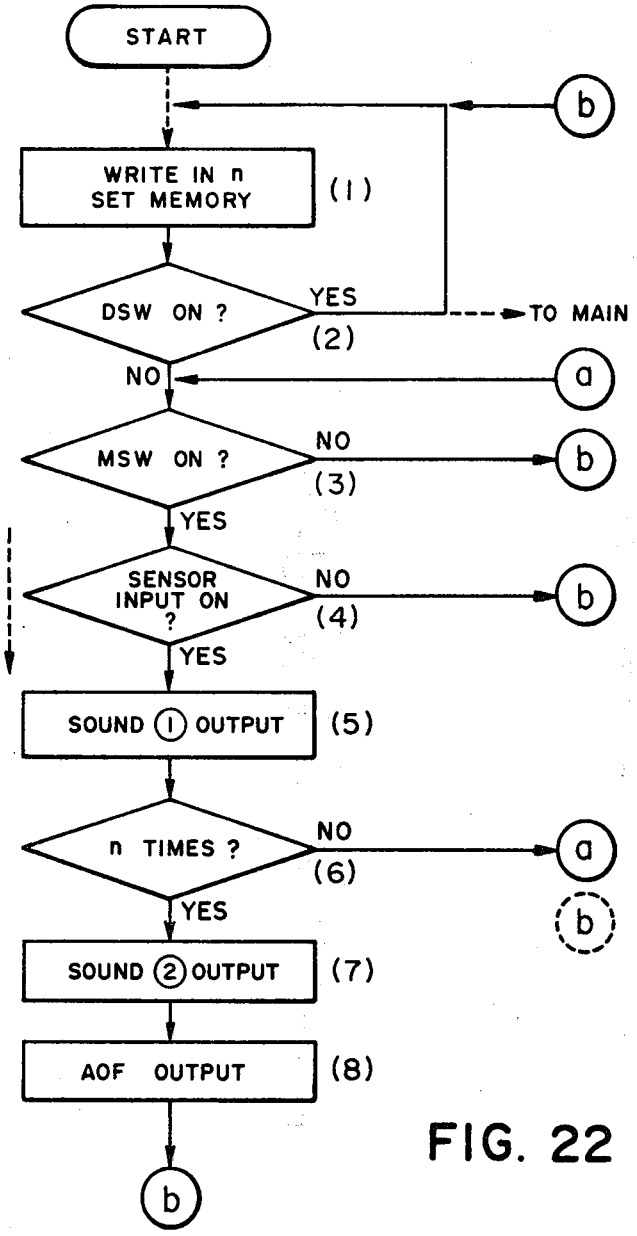
FIG. 22 is a control flow chart of the FIG. 20A circuit.

Operation will now be described with reference to the control flow chart of FIG. 22. This flow is contained in the program ROM of CPU and is designed to execute the program from start upon turn-on of the power (+V) to CPU. This +V is connected to a battery or an AC connector. If the repetition number of the sound is required, n is first set to $n_1$ or $n_2$. This is accomplished by using the ten-key which sets the copying repetition number and, when nothing is done, 1 is set (step 1). Next, whether the door switch or the original cover switch DSW is open is determined (2). The door switch is determined before copying or during interruption of copying, and the cover switch is determined after completion of copying. It inputs to CPU a signal having detected the condition of the switch DSW to cause the CPU to determine. When DSW is OFF (open), whether the main switch MSW is closed is determined (3). It inputs to CPU a signal having detected the condition of the switch MSW to cause the CPU to determine. This signal is the DC power turned on and off by DSW and MSW which has been decreased in level. When the main switch is ON (closed), the input of the extraneous light sensor 402-1 is determined (4). In the case of the auto shut after jam, the door switch may be determined and for the auto shut after completion of copying, the cover switch may be determined. In the former case, the flow of FIG. 22 is executed during a jam and in the latter case, the same flow is executed during stoppage of the motor.

The signal detected by the ambient brightness detecting sensor 402-1 is processed and converted into a digital signal by an A/D converter 402-3. The output from the A/D converter is sent to CPU which controls the copying apparatus, and is compared with a certain predetermined reference value and, when said output is lower than said reference value, signal 1 for generating an alarm from the output terminal of the CPU is put out to sound composite Lsi (5). The sound composite Lsi accesses the characteristic parameters of an appropriate statement from the ROM which stores therein the characteristic parameters of prepared statements, on the basis of the signal put out from the CPU. The characteristic parameters are individual parameters obtained by band-compressing the statement sounds, and refer to parameters representative of pitch frequency, power spectrum, voiced sounds, voiceless sounds, amplitude, etc. Subsequently, the sound composite Lsi, on the basis of the aforementioned characteristic parameters, prepares digital information of statement sound by the use of a digital filter or the like, and transmits it to a D/A converter. The D/A converter converts the digital signal into an analog signal and puts out the analog signal to the next stage amplifier, which thus drives the speaker 230. Accordingly, the speaker 230 puts out the statement sound based on said characteristic parameters.

The sensor 402-1 is provided near the original carriage glass so as to be capable of detecting whether brightness is varied by turn-off of the exposure lamp and thereby determining that copying has been terminated. During the time of significant brightness, the program returns to the routine for determining the switches DSW and MSW.

The previous output 1 is repeated a set number of times n, whereafter the output 1 is stopped and instead, the alarm output 2 is put out (7), thus alerting the operator that power is forcibly cut off. When the main switch is opened during the n times of alarm, the alarm is stopped and the program returns to the initial routine and stands by.

FIG. 21B shows the arrangement of switch and sensors for preventing one from forgetting to open the power switch of an automotive vehicle, particularly, to turn off headlights and other lamps. D designates doors, DSW denotes a switch adapted to be closed and opened by opening-closing of the door, B designates bumpers, and photosensors 402-1 and 402-2 are disposed near the headlights. With MSW as a lamp switch, the aforementioned preventing control can be effected by the same flow as that of FIG. 22. Instead of the photosensors, a microphone may be provided to determine a sound of noise and thereby effect the above-described operation.

Now, it is possible that when the door is opened to open the door switch during copying, "first open" is indicated in sound and it is also indicated by LED. This can be accomplished by a flow in which step 4 is cancelled as indicated by dotted line and a of step 6 is changed to b and by periodically executing such flow during copying. Also, before copying and after completion of copying, an indication different from sounds 1 and 2 can be effected.

What we claim is:

1. A copying apparatus comprising:

copying process means for forming an image on a copy medium;

means for presetting the number of times for which copying is to be repeated;

delay means for inhibiting the starting of copying after closing of a main switch;

means for instructing to start copying;

sequence control means for starting the copying in response to said start means after the delay of said delay means has been released and for rendering said process means ready for the next cycle of copying after the repeated copying by said preset means has been terminated;

means for providing an accoustic warning of a malfunction in said apparatus or of the delay of said copying; and means for controlling the tone quality or sound volume of said warning means in accordance with the sequence of said sequence control means.

2. A copying apparatus according to claim 1, wherein said warning means provides an oral statement.

3. A copying apparatus according to claim 2, wherein said warning means has a filter for filtering an acoustic wave.

4. A copying apparatus according to claim 1, wherein said warning means generates an oral sound when the delay of said delay means is released.

5. A copying apparatus according to claim 1, wherein said warning means generates an oral sound when a trouble occurs, and increases its sound volume or varies its statement during the copying sequence.

6. A copying apparatus according to claim 5, wherein said warning means reduces its sound volume before or after completion of the copying sequence.

7. A copying apparatus according to claim 1, wherein the sound volume is made to differ between the image formation cycle in said sequence and the other times of operation of said apparatus.

8. A copying apparatus comprising:

process means for forming an image on a copy medium;

means for repetitively causing the image formation;

means for detecting the jam of the copy medium or the trouble of the process at a plurality of locations;

means for stopping the image formation operations;

means for providing an acoustic warning; and means responsive to said detecting means for controlling said stop means and said warning means to effect a different copying stop opration and a warning of different tone quality in accordance with the location at which jamming or trouble has occurred.

9. A copying apparatus according to claim 8, wherein said control means causes different statement sounds in accordance with different locations at which a jam has occurred.

10. A copying apparatus according to claim 8, wherein said control means includes a memory means for storing the numer of copied sheets which have been obtained at the time of a copy stop operation.

11. A copying apparatus comprising:

a plurality of process means for forming an image on a copy medium;

means for causing repetitive image formations to continue;

means for detecting any malfunctioning of said process means;

means for detecting a jam of said copy medium;

means for controlling said process means to suspend the repetitive image formation operation in response to the detecting operation of said malfunctioning detecting means or said jam detecting means;

means for generating different alarms in response to the detecting operations of said malfunctioning detecting means and said jam detecting means;

means for effecting different indications in response to the detecting operations of said malfunctioning detecting means and said jam detecting means; and means for selectively controlling whether both said alarm generating means and said indication means are to be operated, or whether only said indication means is to be operated.

12. A copying apparatus according to claim 11, wherein said alarm means warns in different statement sounds in response to said detecting operations.

13. A copying apparatus according to claim 11, wherein said alarm means has a filter for filtering an acoustic wave and selects different parameters.

14. A copying apparatus according to claim 11, wherein said indication means has different LED's adapted to be turned on and off in response to said detecting operations.

15. A copying apparatus comprising process means for forming an image on a copy medium, means for effecting repetitive image formation, means for detecting a trouble or jam in said copying apparatus, means for suspending the repetitive copying in the event of jam or trouble and for causing a sound warning and latching of said sound warning, wherein when a housing door of said apparatus is opened, the latched sound is stopped.

16. A copying apparatus according to claim 15, wherein said latch means warns in different statement sounds in accordance with locations whereat trouble has occured and latches said warnings in accordance with said locations.

17. A copying apparatus according to claim 15, wherein the latched statement sounds are stopped by the use of a switch for releasing the copying re-start prevention or a key for releasing the number of repetitive copying operations.

18. A copying apparatus according to claim 15, wherein when the housing door of said apparatus is opened and the latched sound is stopped, a warning indication persists.

19. A copying apparatus having means for warning of sheet jam, process trouble or the like in statement sound, and wherein after said statement sound has been repeated a predetermined number of times, said statement sound is stopped.

20. A copying apparatus according to claim 19, wherein said number of times is made to differ in accordance with the substance of the statement or with the utterance time zone.

21. A copying apparatus according to claim 19, further having a manual switch for selecting said number of times.

22. A copying apparatus having means for warning of sheet jam, process trouble or the like in statement sound, and wherein the interval at which said statement sound is repeated is made to differ in accordance with the time within the process cycle at which the trouble is detected.

23. A copying apparatus according to claim 22, further having a manual switch for selecting said interval.

24. A copying apparatus comprising process means for forming an image on a copy medium, means for effecting repetitive image formation, means for detecting a trouble or jam in said apparatus, means for suspending the repetitive copying in the event of jam or trouble and for effecting an acoustic warning, and switch means for giving instruction of a trouble treating procedure, in a sound statement by said warning means, when a trouble or jam has occurred.

25. A copying apparatus according to claim 24, wherein a plurality of said detecting means are provided, warnings are given by said warning means in different statement sounds in accordance with a location whereat the jam or trouble has occurred, and statements of different procedures are uttered by said warning means through said switch.

26. A copying apparatus comprising a plurality of process means for forming an image on a copy medium, means for causing repetitive image formation to continue, sensor means for detecting the trouble of said process means, statement sound generating means, and control means for varying the statement sound from said statement sound generating means by a plurality of signals put out from said sensor means in accordance with various troubles.

27. A copying apparatus according to claim 26, wherein said trouble means is connected to said generating means through an A/D converter.

28. A copying apparatus having a speaker for a warning of sheet jam or process trouble in an oral statement, manual switch means for causing a data which is to be entered for copying by an operator to be taught in oral statements before the image formation on a copy medium is started, and means for controlling the operation of said speaker by said switch means, wherein said control means effects a soundless indication or an utterance of a predetermined statement different from said oral statements when said switch means is operated after the start of the sequence.

29. A copying apparatus according to claim 28, wherein said control means effects said utterance when said switch means is operated after entry of the data.

30. A copying or printing apparatus comprising:

copying process means;

means for detecting a condition of the machine;

a speaker; and means for operating said speaker to effect an oral instruction by said detecting means when the said condition of the machine is detected as being normal.

31. An apparatus according to claim 30, wherein said operating means puts out an oral statement upon completion of copying when the desired number of copies exceeds a predetermined number.

32. An alarm device having means for detecting ambient brightness or sound, a power switch, warning means, and control means for operating said warning means in response to the detection signal and an input condition signal caused by said power switch.

33. An alarm device according to claim 32, wherein said control means includes means for rendering warning possible and warns under the possible condition of said warning possible means.

34. An alarm device according to claim 32, wherein said warning means warns in oral sound by statement.

35. An alarm device according to claim 32, wherein said control means forcibly cuts off the input by said power switch after it has continued a warning for a predetermined time or repeated the warning a predetermined number of times.

36. A copying apparatus comprising:

process means for forming an image on a copy medium; means for repetitively causing the image formation;

means for detecting conditions of the machine; and means for effecting an alarm for said condition of the machine with different statement sounds or different times of sound.

37. A copying apparatus according to claim 36 wherein said alarm means provides the arm for the same condition of the machine with the different statement sounds or different times of sound in accordance with a copy sequence.

38. A copying apparatus comprising:

process means for forming an image on a copy medium;

means for repetitively causing the image formation;

means for detecting the jam of the copy medium or the trouble of the process at a plurality of locations; and means for providing an alarm of an occurence of the jam or trouble with sound, said alarm means providing the alarm with different quantities of sound and a statement sound.

39. A copying apparatus according to claim 38 further comprising switch means wherein said alarm means generates the alarm sound until said switch means turns on, and generates the statement sound lower in quantity of sound than the alarm sound after said switch means turns on.

40. A copying apparatus comprising:

a plurality of process means for forming an image on a copy medium;

means for causing repetitive image formation to continue;

means for detecting a jam or trouble in said copying apparatus; and means for providing a sound alarm in accordance with the jam or trouble, wherein said alarm means varies the quantity of sound in accordance with a location of occurrence of the jam or trouble.

41. A copying apparatus according to claim 40, wherein said alarm means provides the alarm with different statement sounds in accordance with the location of occurrence of the jam or trouble.

42. A copying apparatus comprising process means for forming an image on a copy medium, means for effecting repetitive image formation, means for detecting a condition of the machine, and sound generating means for informing of the condition of the machine with a statement sound, said sound generating means storing statements of at least two languages.

43. A copying apparatus according to claim 42 further comprising selecting means for selecting the statements stored in said sound generating means.

44. A copying or printing apparatus comprising:

copying process means;

means for detecting the condition of the machine or for entering data;

a speaker;

means for operating said speaker to effect an oral warning or oral instruction by said detecting or entering means; and means for causing said oral warning or instruction to be put out in a series independently of said detecting or entering means.

45. An apparatus according to claim 30 wherein said oral instruction is a wait or a copy-end instruction.

* * * * *

UNITED STATES PATENT AND TRADEMARK OFFICE

CERTIFICATE OF CORRECTION

PATENT NO. : 4,412,735

DATED : November 1, 1983

INVENTOR(S) : MASAHARU TSUKATA, ET AL.

It is certified that error appears in the above-identified patent and that said Letters Patent is hereby corrected as shown below:

COLUMN 1

Line 63, change "rotation" to read --rotation--.

COLUMN 6

Line 7, after "in" insert --the--.

Line 66, after "of" (2nd occurrence) insert --a--.

COLUMN 10

Line 27, change "input" to read --entered--.

Line 42, change "$74_3$" to read --$\theta_3$--.

COLUMN 11

Line 13, change "outs" to read --out--.

Line 48, change "given" to read --give--.

COLUMN 17

Lines 23 and 24, change "dangerousness" to read --danger--.

Line 24, before "jam" insert --a--.

COLUMN 19

Line 21, change "machiine" to read --machine--.

UNITED STATES PATENT AND TRADEMARK OFFICE

CERTIFICATE OF CORRECTION

PATENT NO. : 4,412,735

DATED : November 1, 1983

INVENTOR(S) : MASAHARU TSUKATA, ET AL.

It is certified that error appears in the above-identified patent and that said Letters Patent is hereby corrected as shown below:

COLUMN 19

Line 23, delete "the" (2nd occurrence).

CLAIM 1

Line 16, change "accoustic" to read --acoustic--.

CLAIM 8

Line 51, change "opration" to read --operation--.

CLAIM 10

Line 60, change "numer" to read --number--.

CLAIM 37

Line 16, change "arm" to read --alarm--.

Signed and Sealed this

*Seventeenth* Day of *April 1984*

[SEAL]

*Attest:*

GERALD J. MOSSINGHOFF

*Attesting Officer*

*Commissioner of Patents and Trademarks*